US007719502B2

(12) United States Patent
Hanaoka et al.

(10) Patent No.: US 7,719,502 B2
(45) Date of Patent: May 18, 2010

(54) LIQUID CRYSTAL DISPLAY DEVICE AND TELEVISION RECEIVER SET

(75) Inventors: Kazutaka Hanaoka, Kawasaki (JP); Yohei Nakanishi, Kawasaki (JP); Yuichi Inoue, Kawasaki (JP); Tsuyoshi Kamada, Kawasaki (JP); Keiji Hayashi, Kawasaki (JP); Kazuya Ueda, Kawasaki (JP)

(73) Assignees: Fujitsu Limited, Kawasaki (JP); Au Optronics Corporation, Hsinchu (TW)

( * ) Notice: Subject to any disclaimer, the term of this patent is extended or adjusted under 35 U.S.C. 154(b) by 1425 days.

(21) Appl. No.: 11/064,898

(22) Filed: Feb. 24, 2005

(65) Prior Publication Data

US 2005/0259056 A1 Nov. 24, 2005

(30) Foreign Application Priority Data

May 24, 2004 (JP) ..... 2004-153924

(51) Int. Cl.
*G09G 3/36* (2006.01)

(52) U.S. Cl. ..... 345/87; 345/89; 345/690

(58) Field of Classification Search ..... 345/87, 345/89, 690; 349/35, 117, 123
See application file for complete search history.

(56) References Cited

U.S. PATENT DOCUMENTS 6,952,252 B2 10/2005 Nakanishi
6,977,704 B2 12/2005 Kataoka
7,372,533 B2 5/2008 Inoue et al.
2001/0030726 A1 * 10/2001 Yoshida et al. ..... 349/117
2003/0048401 A1 * 3/2003 Hanaoka et al. ..... 349/123

FOREIGN PATENT DOCUMENTS

| | | |
|---|---|---|
| EP | 1 443 486 | 8/2004 |
| EP | 1 443 487 | 8/2004 |
| JP | 2002-107730 | 4/2002 |
| JP | 2002-357830 | 12/2002 |
| JP | 2003-057622 | 2/2003 |
| JP | 2003-177418 | 6/2003 |
| JP | 2004-118179 | 4/2004 |
| KR | 2002-0077154 | 10/2002 |
| KR | 2003-0027202 | 4/2003 |

* cited by examiner

*Primary Examiner*—Amare Mengistu
*Assistant Examiner*—Yuk Chow
(74) *Attorney, Agent, or Firm*—Greer, Burns & Crain, Ltd.

(57) ABSTRACT

An MVA liquid crystal display device for displaying motion pictures includes a polymer layer formed on a surface of a vertical alignment film so as to tilt liquid crystal molecules in the liquid crystal layer slightly from a direction perpendicular to the plane of the liquid crystal layer. Further, the MVA liquid crystal display device of such a construction is subjected to overdriving.

20 Claims, 18 Drawing Sheets

LIQUID CRYSTAL DISPLAY DEVICE AND TELEVISION RECEIVER SET

CROSS-REFERENCE TO RELATED APPLICATION

The present application is based on Japanese priority application No. 2004-153924 filed on May 24, 2004, the entire contents of which are hereby incorporated by reference.

BACKGROUND OF THE INVENTION

The present invention generally relates to liquid crystal display devices and more particularly to a liquid crystal display device of vertical alignment (VA) mode.

A liquid crystal display device is a display device having the feature of compact size and small electric power consumption. Thus, a liquid crystal display device has been used extensively for various portable information processing apparatuses, particularly laptop computers or cellular phones. On the other hand, much progress has been made with regard to the performance of liquid crystal display device in the past, including the response speed and contrast ratio, and a liquid crystal display device is used nowadays also for replacing conventional CRT display apparatuses of desktop computers and workstations.

Further, in recent years, there are increasing instances in which a liquid crystal display device is used for displaying images in a television set ranging from a large screen television set to a compact portable television set. In the case of using a liquid crystal display device for a television set, there is imposed a demand that the liquid crystal display device is capable of displaying a motion picture with high speed.

Meanwhile, a liquid crystal display device of the vertical alignment mode, particularly the liquid crystal display device of MVA mode is used extensively for the display devices of computers and cellular phones in view of its excellent contrast ratio and wide viewing angle characteristics. It should be noted that the liquid crystal display device of MVA mode or MVA liquid crystal display device is a liquid crystal display device in which there are formed plural domains of different tilting directions of liquid crystal molecules in a single pixel region.

Thus, there is a natural demand of using such a liquid display device of MVA mode also for the display of television images.

FIGS. 1A and 1B are diagrams showing the principle of a MVA liquid crystal device 10 proposed by the inventor of the present invention, wherein FIG. 1A shows the liquid crystal display device 10 in the non-activated state in which there is applied no driving electric field to a liquid crystal layer 12, while FIG. 1B shows the same liquid crystal display device 10 in an activated state in which a driving electric field is applied to the liquid crystal layer 12.

Referring to FIG. 1A, the liquid crystal layer 12 is held between a glass substrate 11A and a glass substrate 11B, wherein the glass substrate 11A and 11B form a liquid crystal panel together with the liquid crystal layer 12.

On each of the glass substrates 11A and 11B, there are formed respective alignment films not illustrated, wherein the alignment films control the pointing direction of the liquid crystal molecules of the liquid crystal layer 12 such that the liquid crystal molecules are aligned in a direction generally perpendicular to the liquid crystal layer 12 in the non-activated state in which no drive electric field is applied to the liquid crystal layer 12.

In this state, the optical beam incident to the liquid crystal display device undergoes no substantial rotation of its polarization plane as it passes through the liquid crystal layer, and thus, the optical beam incident to the liquid crystal layer 12 through a polarizer is interrupted by an analyzer, provided that the polarizer and the analyzer are disposed above and below the liquid crystal panel in a crossed Nicol relationship.

In the activated state of FIG. 1B, on the other hand, the liquid molecules are tilted as a result of the applied electric field, and because of this, the optical beam incident to the liquid crystal layer undergoes rotation of the polarization plane thereof. As a result, the optical beam incident to the liquid crystal layer 12 through the polarizer passes also through the analyzer.

Further, in the liquid crystal display device 10 of FIGS. 1A and 1B, there are formed projecting patterns 13A and 13B respectively on the glass substrates 11A and 11B so as to extend parallel with each other, wherein the projecting patterns 13A and 13B impose localized constraint with regard to the tilting direction of the liquid crystal molecules particularly at the time of transition from the non-activated state to the activated state. With this, the response speed of the liquid crystal display device 10 is improved.

By forming such projecting patterns 13A and 13B, not only the response speed of the liquid crystal display device 10 is improved, but there are also formed plural domains of different tilting directions of the liquid crystal molecules in the liquid crystal layer. Thereby, the viewing angle characteristics of the liquid crystal display device are improved significantly.

[Patent Reference 1] Japanese Laid-Open Patent Application 2002-107730 gazette

[Patent Reference 2] Japanese Laid-Open Patent Application 2002-357830 gazette

SUMMARY OF THE INVENTION

Thus, with a liquid crystal display device of MVA type, nearly ideal black representation is realized in the non-activated state thereof, and thus, a high contrast ratio is achieved. Further, because of the constraint imposed by the projecting patterns 13A and 13B with regard to the tilting direction of the liquid crystal molecules, a high response speed is achieved for such a liquid crystal display device, which is designed for displaying primarily static images.

On the other hand, in the case of displaying motion picture images by using such an MVA liquid crystal display device, there arises a problem, in view of the mechanism of transition of the liquid crystal molecules in such an MVA liquid crystal display device in that the transition occurs first in the region in the vicinity of the projecting patterns 13A and 13B and then propagates to the region of the liquid crystal layer other than the protecting patterns 13A and 13B, in that the response speed is not sufficient for such a purpose of displaying motion picture images as in the case of television. For example, one may encounter the problem that the displayed images are blurred.

Hereinafter, this problem of response speed will be explained for the example of the conventional MVA liquid crystal display device 30 shown in FIG. 2.

Referring to FIG. 2, the liquid crystal display device 30 is an active-matrix device and includes a TFT glass substrate 31A carrying thereon a large number of thin film transistors (TFTs) and transparent pixel electrodes each cooperating with one TFT, and an opposing glass substrate 31B opposing the TFT glass substrate 31A and carrying thereon an opposing electrode, wherein a liquid crystal layer 31 is confined between the substrates 31A and 31B by a seal member 31C. In the illustrated liquid crystal display device, the pointing direction of the liquid crystal molecules is changed selectively in the liquid crystal layer 31 in correspondence to a selected pixel electrode driven by a corresponding TFT. Further, it should be noted that there are disposed a polarizer 31*a* and an analyzer 31*b* at respective outer sides of the glass substrates 31A and 31B in a crossed Nicol relationship. In addition, there are formed alignment films at the inner sides of the glass substrates 31A and 31B in contact with the liquid crystal layer 31, wherein the alignment films restrict the pointing direction of the liquid crystal molecules in the direction generally perpendicular to the plane of the liquid crystal layer 31 in the non-activated state thereof.

For the liquid crystal layer 31, it is possible to use a liquid crystal having a negative dielectric anisotropy marketed from Merck Ltd, Japan, while it is possible to use a vertical alignment film provided by JSR Corporation for the foregoing alignment films. In a typical example, the substrates 31A and 31B are assembled by using suitable spacers so that the liquid crystal layer 31 held therebetween has a thickness of about 4 μm.

FIG. 3A shows the liquid crystal display device of FIG. 2 in a cross-sectional view, while FIG. 3B shows a part of the TFT glass substrate 31A in an enlarged scale.

Referring to FIG. 3A, it can be seen that there are formed pixel electrodes 34 on the lower glass substrate 31A constituting the TFT substrate in electrical connection to corresponding TFTs 31T, wherein the pixel electrodes 34 are covered with a vertical molecular alignment film 35. Further, an opposing electrode 36 is formed uniformly on the upper glass substrate 31B, and the opposing electrode 36 is covered by another molecular alignment film 37.

Thereby, the liquid crystal layer 33 is held between the substrates 31A and 31B in the state that the liquid crystal layer 33 makes a contact with the alignment films 35 and 37.

Referring to FIG. 3B, the glass substrate 31A carries thereon a large number of pad electrodes 33A to which a scanning signal is supplied, wherein it can be seen that a large number of scanning electrodes 33 extend therefrom. Further, the glass substrate 31A carries thereon a large number of pad electrodes 32A to which a video signal is supplied and a large number of signal electrodes 32 extend therefrom in the direction generally perpendicular to the extending direction of the scanning electrodes 33. Further, TFTs 31T are formed at the intersections of the scanning electrodes 33 and the signal electrodes 32. Further, on the substrate 31A, there are formed transparent pixel electrodes 34 in correspondence to the TFTs 31T, wherein each of the TFTs 31T is selected by a scanning signal on the corresponding scanning electrode 33 and drives the cooperating transparent pixel electrode 34 formed of ITO, or the like, by video signal on the corresponding signal electrode 32.

In the non-activated state in which no drive voltage is applied to the transparent pixel electrode 34, the liquid crystal molecules are aligned in the liquid crystal display device 30 in the direction generally perpendicular to the plane of the liquid crystal layer 31 and a dark representation is achieved as a result of the function of the polarizer 31*a* and the analyzer 31*b* disposed in the crossed Nicol relationship. On the other hand, in the activated state in which a drive voltage is applied to the transparent pixel electrode 34, the liquid crystal molecules are aligned generally horizontally, and a white representation is achieved.

As shown in FIG. 3A, there are formed cutout patterns 34A in the pixel electrode 34, and the alignment film 35 is formed so as to cover the cutout patterns 34A. Further, there are provided projecting patterns 36A on the upper electrode 36 as a result of patterning of a monomer film such as a resist film.

Thereby, it should be noted that the projecting patterns 36A cause localized tilting in the liquid crystal molecules similarly to the projecting patterns 13B of FIGS. 1A and 1B. Further, the cutout patterns 34A also induce localized modification of electric field distribution and cause localized titling in the liquid crystal molecules similarly to the projecting patterns shown in FIGS. 1A and 1B.

FIG. 4 shows the construction of a single pixel electrode 34 formed on the substrate 31A in detail.

Referring to FIG. 4, it can be seen that the signal electrodes 32 and the scanning electrode 33 extend in the crossing relationship on the substrate 31A and that a TFT 31T and a pixel electrode 34 cooperating therewith are formed in correspondence to each intersection of the electrodes 32 and 33. Further, it can be seen that auxiliary capacitance 34C (Cs) is formed parallel to each of the scanning electrodes 33 in the construction of FIG. 4.

In FIG. 4, it will be noted that the pixel electrode 34 shown by a mat pattern is divided into regions A and B, and each of the regions A and B is formed with the cutout patterns 34A shown in white such that the cutout patterns 34A extend parallel with each other in correspondence to the construction of FIGS. 1A and 1B explained before.

Further, in FIG. 4, there are also shown the projecting patterns 36A formed on the glass substrate 31B, in addition to the pixel electrode 34 formed on the substrate 31A.

FIG. 5 shows the transition of transmittance of the MVA liquid crystal display device 30 of FIG. 2 caused in correspondence to the transition of state of the liquid crystal display device 30 from the dark state in which no drive signal is supplied to the white stated in which a drive signal of ±2.5V is supplied. In FIG. 4, the horizontal axis represents the time while the vertical axis represents the transmissivity.

Referring to FIG. 5, it should be noted that no drive signal is supplied to the pixel electrode 34 in the first interval T1 and the liquid crystal display device 30 is in the dark state. On the other hand, in the interval T2, a drive voltage of 2.5V is applied in the form of a rectangular waveform signal, and the liquid crystal display device 30 causes transition to the white state. Thereby, it should be noted that each of the rectangular waves has a duration t1 corresponding to one frame. In the case of displaying an image of 60 frames per second, the duration t1 of one frame should be 16.7 ms.

Thus, in the case the liquid crystal display device 30 is driven like this, it takes a time of several frames until the transmittance fully goes up, while this means that the display cannot follow the change of the images to be displayed in the case the gradation of the image to be displayed is changed within this interval.

Further, from FIG. 5, it will be seen that the liquid crystal display device 30 resumes its black state quickly when the drive voltage has returned to zero in the interval T3 that follows the interval T2.

In order to improve the response speed at the time of transition of state of the liquid crystal display device, it has been practiced in the art to use a so-called overdrive technology, in which the magnitude of the drive voltage pulse is increased beyond a predetermined value corresponding to the desired gradation temporarily at the time of starting the driving or in the first frame of the gradation transition. This overdrive technology is used in various liquid crystal display devices, and it is also possible to use the overdrive technology in the MVA liquid crystal display device of FIG. 3.

FIG. 6 shows the transition of transmittance observed in the same MVA liquid crystal display device 30 used in the experiment of FIG. 5, for the case the overdrive technology is used, in which the magnitude of the drive voltage pulse of the first frame of the interval T2, which follows the interval T1 of 0V drive voltage, is set to +3.1V, and the a nominal drive voltage of ±2.5V is supplied thereafter in the remaining interval T2. In FIG. 6, it should be noted that the drive voltage is returned again to 0V in the interval T3 that follows the interval T2.

Referring to FIG. 6, it can be seen that a very sharp increase of transmittance is achieved at the beginning of the interval T2 as a result of the use of the overdrive technology. On the other hand, it can be seen also that the transmittance swings for a while over the duration of several frames that follow the sharp transition, and it can be seen that it takes time until a constant stable transmittance is reached.

It should be noted that the relationship of FIGS. 5 and 6 is first discovered by the inventor of the present invention in the investigation that constitutes the foundation of the present invention.

It is believed that such instability of transmittance reflects the instability of alignment of the liquid crystal molecules caused in the liquid crystal layer with the overdriving.

In the liquid crystal display device of the MVA type, in which the tilting of the liquid crystal molecules first started in the vicinity of the projecting patterns 13A and 13B or 36A or in the vicinity of the cutout patterns 34A propagates to the entire liquid crystal layer, such instability of alignment of the liquid crystal molecules raises a serious problem.

For example, in the case there has been caused variation of the transmittance that continues for several frames as in the example of FIG. 6, there appears a ghost in the display of motion pictures.

Meanwhile, in the art of liquid crystal display device, it should be noted that each pixel holds an image over the duration of one frame, contrary to the case of a CRT display device. Thus, representation of motion pictures with such a liquid crystal display device tends to cause the problem of afterimages or tailing of images when viewed by human eyes.

Thus, in order to display natural motion picture images with such a liquid crystal display device, it is practiced to use a technology in which the display screen is divided into plural regions each having a corresponding backlight unit, and carry out a quasi-vertical scanning of backlight by switching the backlight units one after another during one frame representation.

On the other hand, according to the experiments made by the inventor of the present invention and constituting the foundation of the present invention, it was discovered that such switching of the backlight unit deteriorates the quality of represented images even further when used with the MVA liquid crystal display devices for displaying motion pictures. The foregoing problem of oscillation or swinging of the transmittance causes this further deterioration of image quality when the MVA liquid crystal display device is used with the overdrive technology and with the backlight switching technology.

According to a first aspect of the present invention, there is provided a liquid crystal display device, comprising:

a first substrate carrying a first electrode;

a first alignment film formed on said first substrate so as to cover said first electrode;

a second substrate carrying a second electrode and opposing said first substrate;

a second alignment film formed on said second substrate so as to cover said second electrode;

a liquid crystal layer sandwiched between said first and second substrates via respective alignment films;

a first polarizer having a first optical absorption axis and disposed outside said first substrate;

a second polarizer having a second optical absorption axis perpendicular to said first optical absorption axis and disposed outside said second substrate; and a drive unit applying a drive voltage signal to said first and second electrodes, said first and second alignment films causing liquid crystal molecules of said liquid crystal layer to align in a direction generally perpendicular to a plane of said liquid crystal layer in a non-activated state of said liquid crystal display device in which no drive voltage is applied across said first and second electrodes, said first electrode constituting a pixel electrode including therein regions characterized by different tilting directions of said liquid crystal molecules, said liquid crystal molecules being inclined in each of said plural regions in a predetermined direction pertinent to said region over generally entirety of a display region of said liquid crystal display device in said non-activated state thereof, said drive unit setting the voltage of a drive voltage signal, in the case of displaying a first gradation image having a first gradation and subsequently and continuously displaying a second gradation image having a second gradation, such that a magnitude of said drive voltage signal is increased larger than a predetermined voltage of said drive signal for said second gradation during a first frame interval of displaying said second gradation image.

In another aspect of the present invention, there is provided a television receiver set, comprising:

a signal processing circuit supplied with a high frequency signal including a video signal and a synchronization signal, said signal processing circuit extracting said video signal and said synchronization signal therefrom;

a drive circuit producing a drive voltage signal from said video signal; and a liquid crystal display device driven by said drive voltage signal, said liquid crystal display device comprising:

a first substrate carrying a first electrode;

a first alignment film formed on said first substrate so as to cover said first electrode;

a second substrate carrying a second electrode and opposing said first substrate;

a second alignment film formed on said second substrate so as to cover said second electrode;

a liquid crystal layer sandwiched between said first and second substrates via respective alignment films;

a first polarizer having a first optical absorption axis and disposed outside said first substrate;

a second polarizer having a second optical absorption axis perpendicular to said first optical absorption axis and disposed outside said second substrate; and a drive unit applying a drive voltage signal to said first and second electrodes, said first and second alignment films causing liquid crystal molecules of said liquid crystal layer to align in a direction generally perpendicular to a plane of said liquid crystal layer in a non-activated state of said liquid crystal display device in which no drive voltage is applied across said first and second electrodes, said first electrode constituting a pixel electrode including therein regions characterized by different tilting directions of said liquid crystal molecules, said liquid crystal molecules being inclined in each of said plural regions in a predetermined direction pertinent to said region over generally entirety of a display region of said liquid crystal display device in said non-activated state thereof, said drive unit setting the voltage of a drive voltage signal, in the case of displaying a first gradation image having a first gradation and subsequently and continuously displaying a second gradation image having a second gradation, such that a magnitude of said drive voltage signal is increased larger than a predetermined voltage of said drive signal for said second gradation during a first frame interval of displaying said second gradation image.

According to the present invention, the problem of swinging of transmittance occurring in the case the overdrive technology is applied to an MVA liquid crystal display device is effectively eliminated by causing the liquid crystal molecules to tilt over generally entire display area in the tilting direction pertinent to the display area. By tilting (pretilting) the liquid crystal molecules over generally entire display area in the tilting direction pertinent to the display area in the non-activated state of the liquid crystal display device, the liquid crystal molecules change the tilting angle thereof substantially simultaneously to a tilting angle corresponding to the desired gradation at the respective locations of the liquid crystal molecules.

Such pretilting of the liquid crystal molecules in the non-activated state of the liquid crystal display device can be easily realized by forming a polymer layer on the vertical alignment film, by optically curing a photocuring monomer composition having a liquid crystal skeleton. Further, by providing a backlight unit behind the liquid crystal display device and by illuminating different regions of the liquid crystal display device consecutively and sequentially by using the backlight unit, it becomes possible to achieve high-performance display of motion pictures characterized by high contrast ratio, wide viewing angle and little after images or blurs.

Further, there occurs no degradation of display image quality even in the case the quasi-vertical scanning caused by switching of the backlight unit is applied simultaneously with the overdriving. It should be noted that there has been caused severe degradation of display image quality of motion pictures when such quasi-vertical scanning has been used in the conventional MVA liquid crystal display devices in combination with the overdrive technology.

Other objects and further features of the present invention will become apparent from the following detailed description when read in conjunction with the attached drawings.

DETAILED DESCRIPTION OF THE INVENTION

Figure 7:
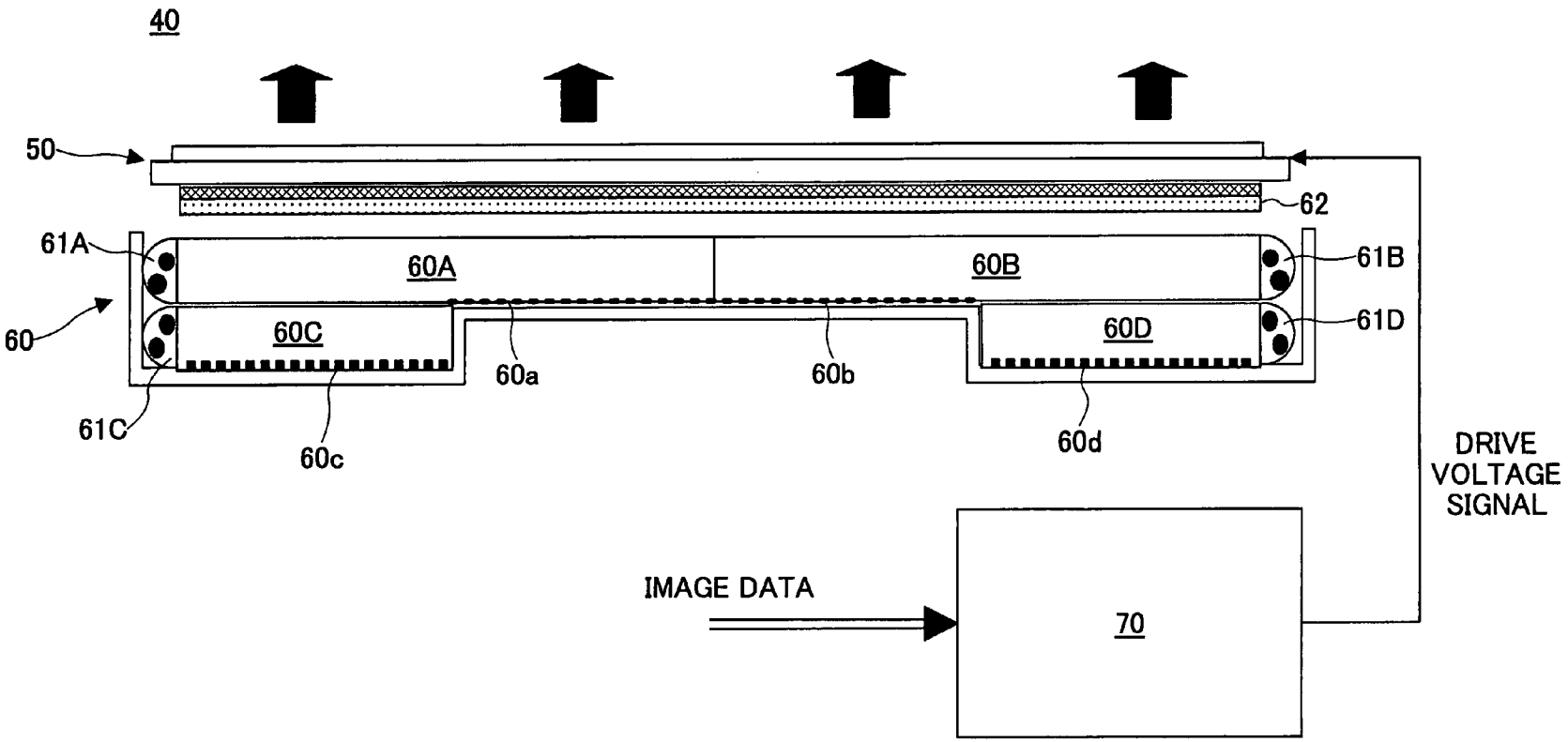
FIG. 7 is a diagram showing the construction of the liquid crystal display device according to a first embodiment of the present invention.

FIG. 7 shows the construction of a MVA liquid crystal display device 40 according to a first embodiment of the present invention.

Referring to FIG. 7, the liquid crystal display device 40 is formed of a liquid crystal display panel 50 of MVA type, a backlight unit 60 disposed behind the liquid crystal display panel 50 and a drive circuit 70 supplied with image data and driving the liquid crystal display panel 50 with a drive voltage signal corresponding to the image data, wherein there is provided a diffusion plate 62 between the backlight unit 60 and the liquid crystal display panel 50. The backlight unit 60 is formed of light sources 61A-61D and respective cooperating optical scatter plates 60*a*-60*d*. Further description of the backlight 60 will be given later.

The light emitted from the backlight unit 60 is modulated by the liquid crystal display panel 50 and is emitted to the front side of the liquid crystal display panel 50.

Figure 8:
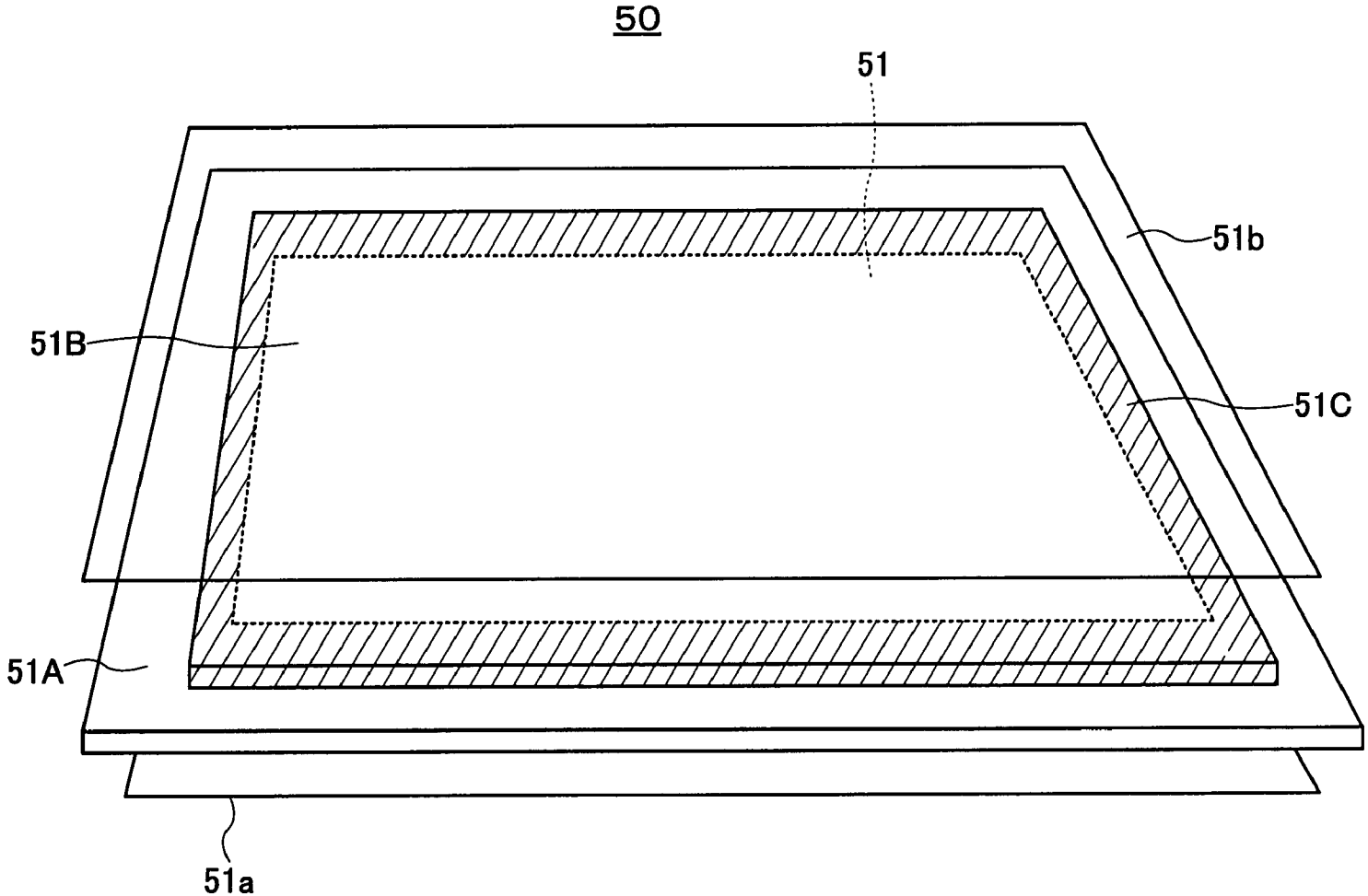
FIG. 8 is another diagram showing the construction of the liquid crystal display device of FIG. 7.

FIG. 8 shows the construction of the liquid crystal display panel 50.

Referring to FIG. 8, the liquid crystal display panel 50 is an active-matrix liquid crystal display apparatus and includes a TFT glass substrate 51A carrying thereon a large number of thin film transistors (TFTs) and transparent pixel electrodes cooperating with the TFTs and an opposing glass substrate 51B provided over the TFT substrate 51A and carrying thereon an opposing electrode, wherein a liquid crystal layer 51 is confined between the substrates 51A and 51B by a seal member 51C.

In the illustrated liquid crystal panel, the pointing direction of the liquid crystal molecules is modulated selectively in the liquid crystal layer 51 by selectively driving a selected transparent pixel electrode via a corresponding TFT.

Further, it should be noted that there are disposed a polarizer 51*a* and an analyzer 51*b* at the respective outer sides of the glass substrates 51A and 51B in a crossed Nicol state.

Further, there are formed alignment films (not shown) at the respective inner sides of the glass substrates 51A and 51B, wherein the alignment films restrict the alignment of the liquid crystal molecules such that the liquid crystal molecules are aligned in the direction generally perpendicular to the plane of the liquid crystal layer 51 in the non-activated state of the liquid crystal display device.

For the liquid crystal layer 51, it is possible to use a liquid crystal having negative dielectric anisotropy marketed from Merck Japan, Ltd.

Further, for the alignment films, it is possible to use a vertical alignment film marketed from JSR Corporation. In a typical example, the substrates 51A and 51B are assembled by using a suitable spacer such that the liquid crystal layer 51 is formed with the thickness of about 4 μm.

Figure 9A:
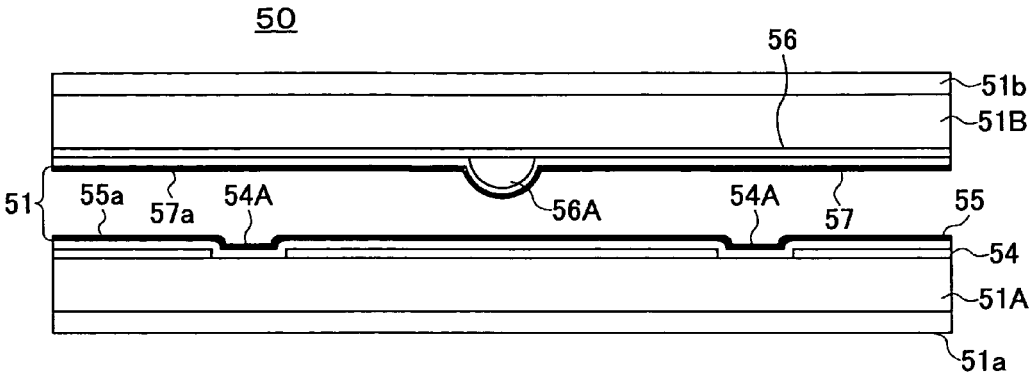
FIGS. 9A and 9B are further diagrams showing the construction of the liquid crystal display device of FIG. 7.
Figure 9B:
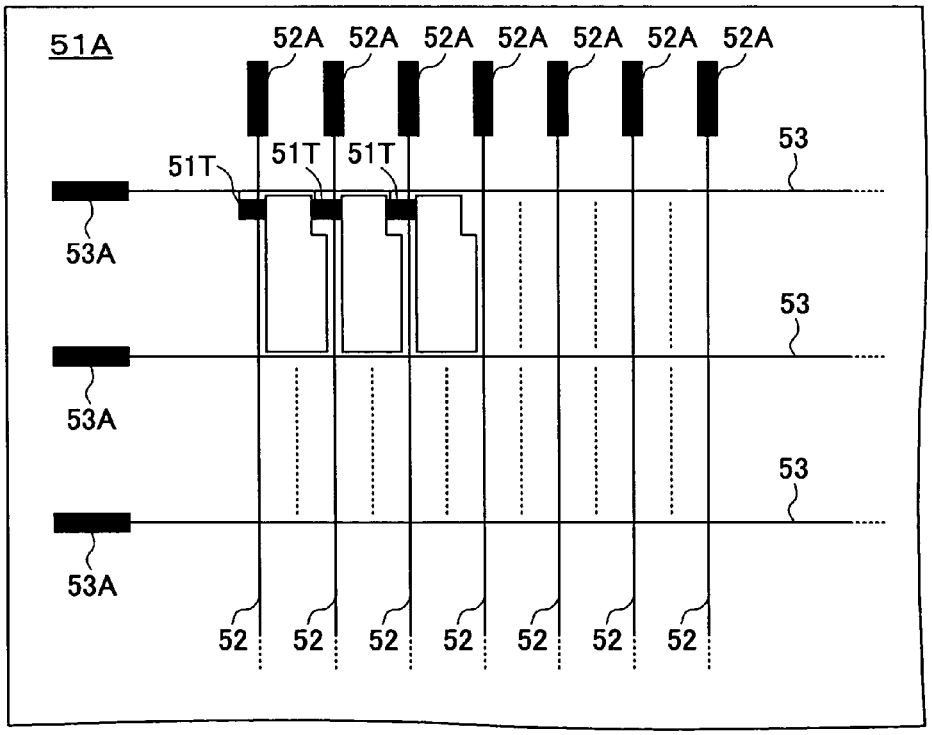

FIG. 9A shows the liquid crystal display panel 50 of FIG. 8 in a cross-sectional view, while FIG. 9B shows a part of the TFT glass substrate 51A in an enlarged view.

Referring to FIG. 9A, a number of pixel electrodes 35 are formed in a row and column formation each in electrical connection with a corresponding TFT 51T not illustrated, wherein the pixel electrode 54 is covered with the vertical alignment film 55. Similarly, the upper glass substrate 51B is covered uniformly by an opposing electrode 56, wherein the opposing electrode 56 is covered with another vertical alignment film 57. Thereby, the liquid crystal layer 51 is sandwiched between the substrates 51A and 51B in the state contacting with the vertical alignment films 55 and 57.

Referring to FIG. 9B, the glass substrate 51A carries thereon a large number of pad electrodes 53A each supplied with a scanning signal and a large number of scanning electrodes 53 extending therefrom, while the glass substrate 51A further carries thereon a large number of pad electrodes each supplied with a video signal and a large number of signal electrodes 52 extending therefrom such that the extending direction of the scanning electrodes and the extending direction of the signal electrodes 52 intersect generally perpendicularly with each other.

At each intersection of the scanning electrodes 53 and the signal electrodes 52, there is formed a TFT 51T, wherein a transparent pixel electrode 54 is formed further on the substrate 51A in correspondence to each of the TFTs 51T. Thus, each TFT 51T is selected by a scanning signal supplied to a corresponding scanning electrode 53, and the TFT thus selected drives the cooperating transparent pixel electrode 54 made of ITO, or the like, by the video signal, which is a driving voltage signal supplied to the corresponding signal electrode 52.

Because the liquid crystal molecules are aligned generally perpendicularly to the plane of the liquid crystal layer 51 in the liquid crystal display panel 50 in the non-activated state thereof in which no drive voltage is applied to the transparent pixel electrode 54, the liquid crystal display panel 50 provides a dark representation due to the function of the polarizer 51*a* and the analyzer 51*b*, while in the activated state in which a drive voltage is applied to the transparent pixel electrode 54, the liquid crystal molecules are aligned generally horizontally, and the liquid crystal display panel provides a white representation.

As will be explained later, the molecular alignment films 55 and 56 have their respective surfaces formed with polymer layers 55*a* and 57*a*, wherein the polymer layers 55*a* and 57*a* induces slight tilting in the liquid crystal molecules in the liquid crystal layer 31 with regard to the plane of the liquid crystal layer 51. Explanation about the polymer layers 55*a* and 57*a* will be given later.

Further, as shown in FIG. 8A, there are formed cutout patterns 54A in the pixel electrode 54, and the alignment film 55 and the polymer layer 55*a* are formed so as to cover the cutout patterns 54A.

Figure 1A:
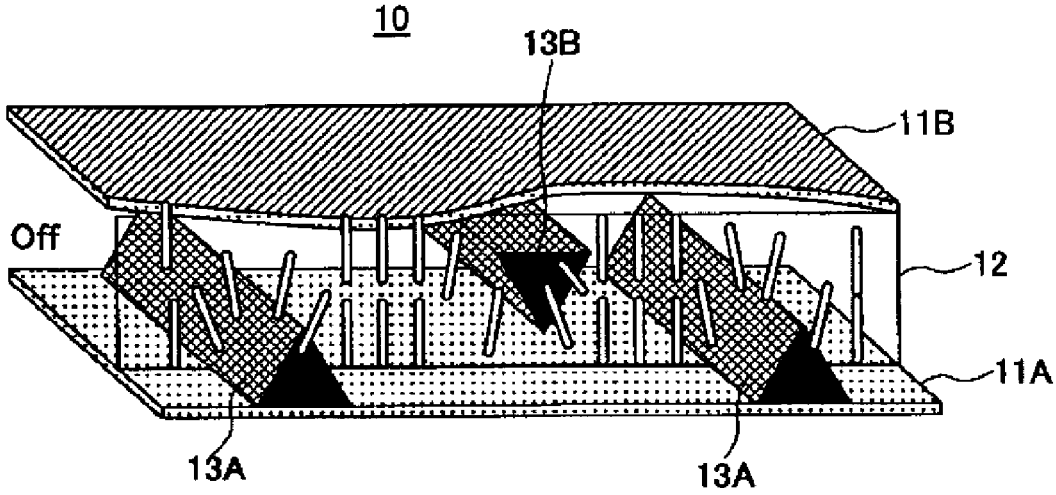
FIG.1A Prior Art
FIGS. 1A and 1B are diagrams explaining the principle of an MVA liquid crystal display device.
Figure 1B:
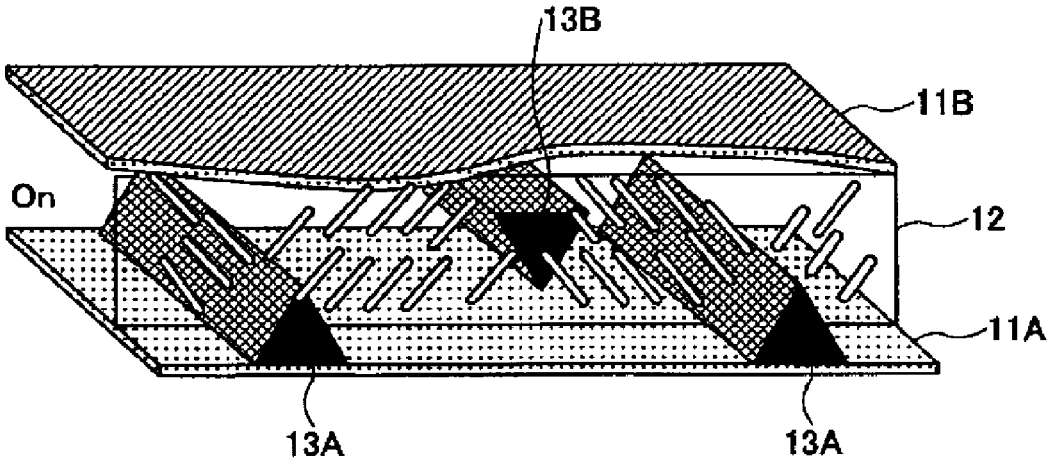
FIG.1B Prior Art
Figure 2:
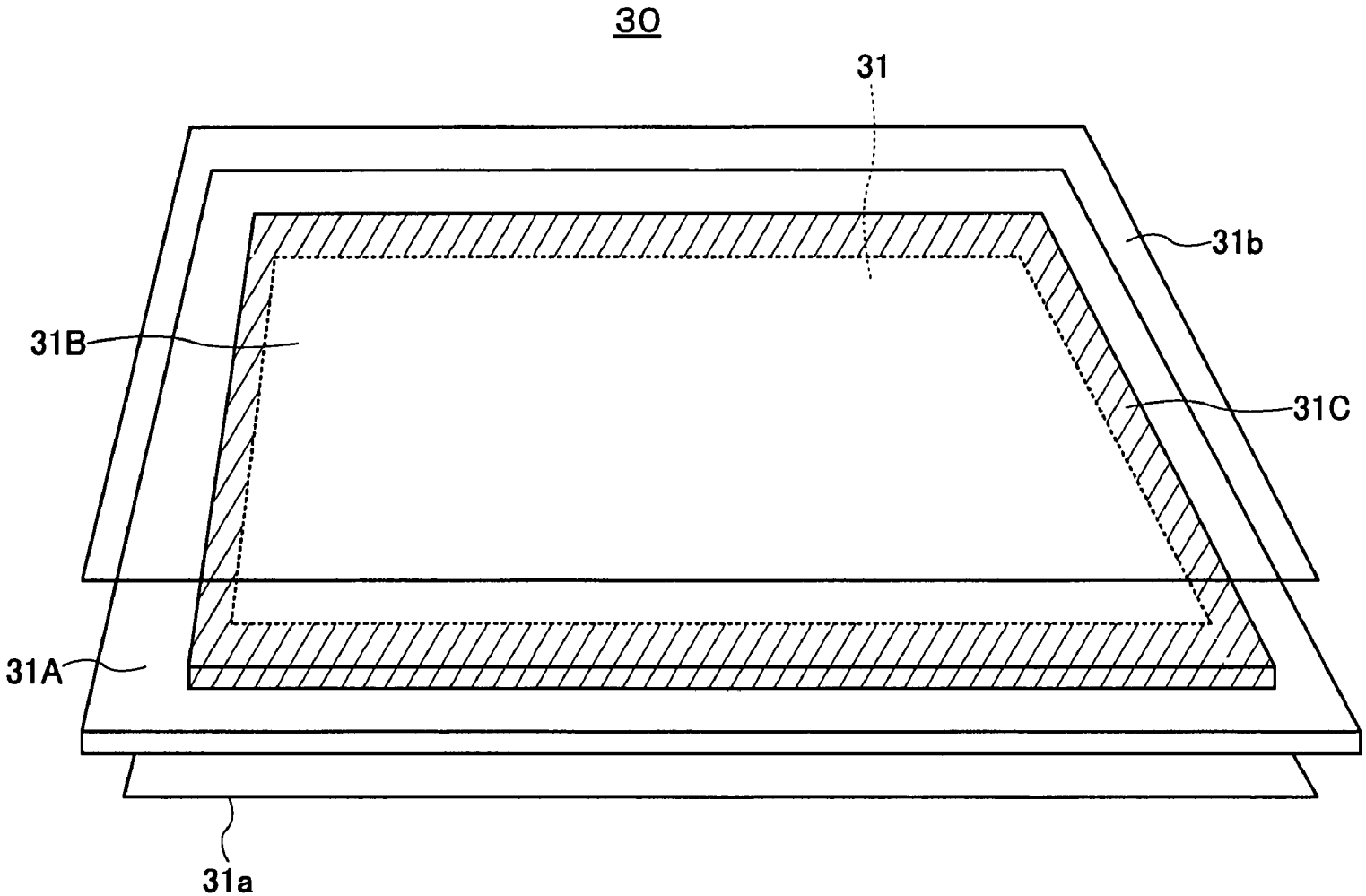
FIG. 2 is a diagram showing the construction of an MVA liquid crystal display device according to the related art.
Figure 3A:
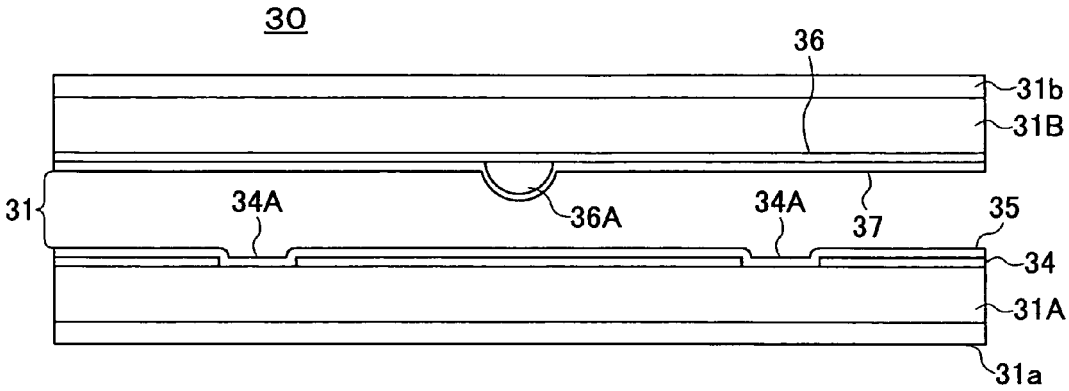
FIGS. 3A and 3B are diagrams showing the construction of the MVA liquid crystal display device of FIG. 2.
Figure 3B:
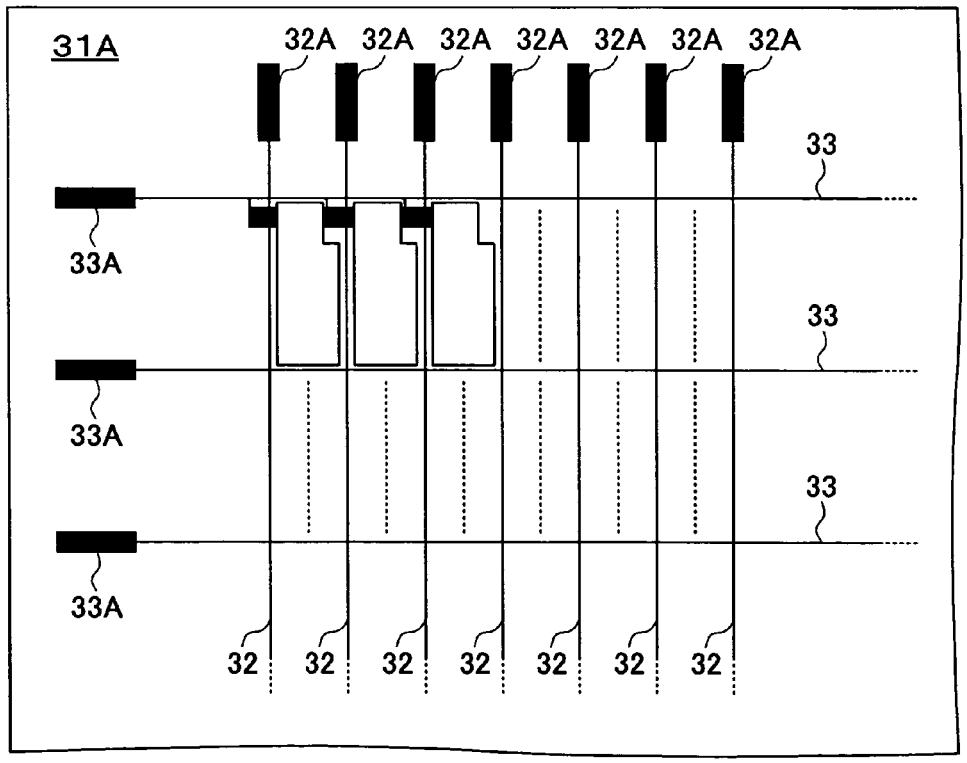

Further, it should be noted that there are formed projection patterns 56A on the upper electrode 56 by patterning of a monomer film such as a resist film. Thereby, the projecting patterns 56A induce a localized tilting of the liquid crystal molecules similar to the case of the projecting pattern 36A of FIG. 3A, while the foregoing cutout patterns 54A also induces similar localized modulation of the electric field, resulting in similar localized tilting of the liquid crystal molecules.

In the construction of FIG. 9A, it is also possible to provide one or more phase compensation films between the glass substrate 51A and the polarizer 51*a* and/or between the glass substrate 51B and the analyzer 51*b*. Such a phase compensation film may be an optically uniaxial phase compensation film in which the refractive indices $n_x$ and $n_y$ in the plane of the liquid crystal layer 51 are larger than the refractive index $n_z$ in the direction in which the optical wave propagates.

Figure 10:
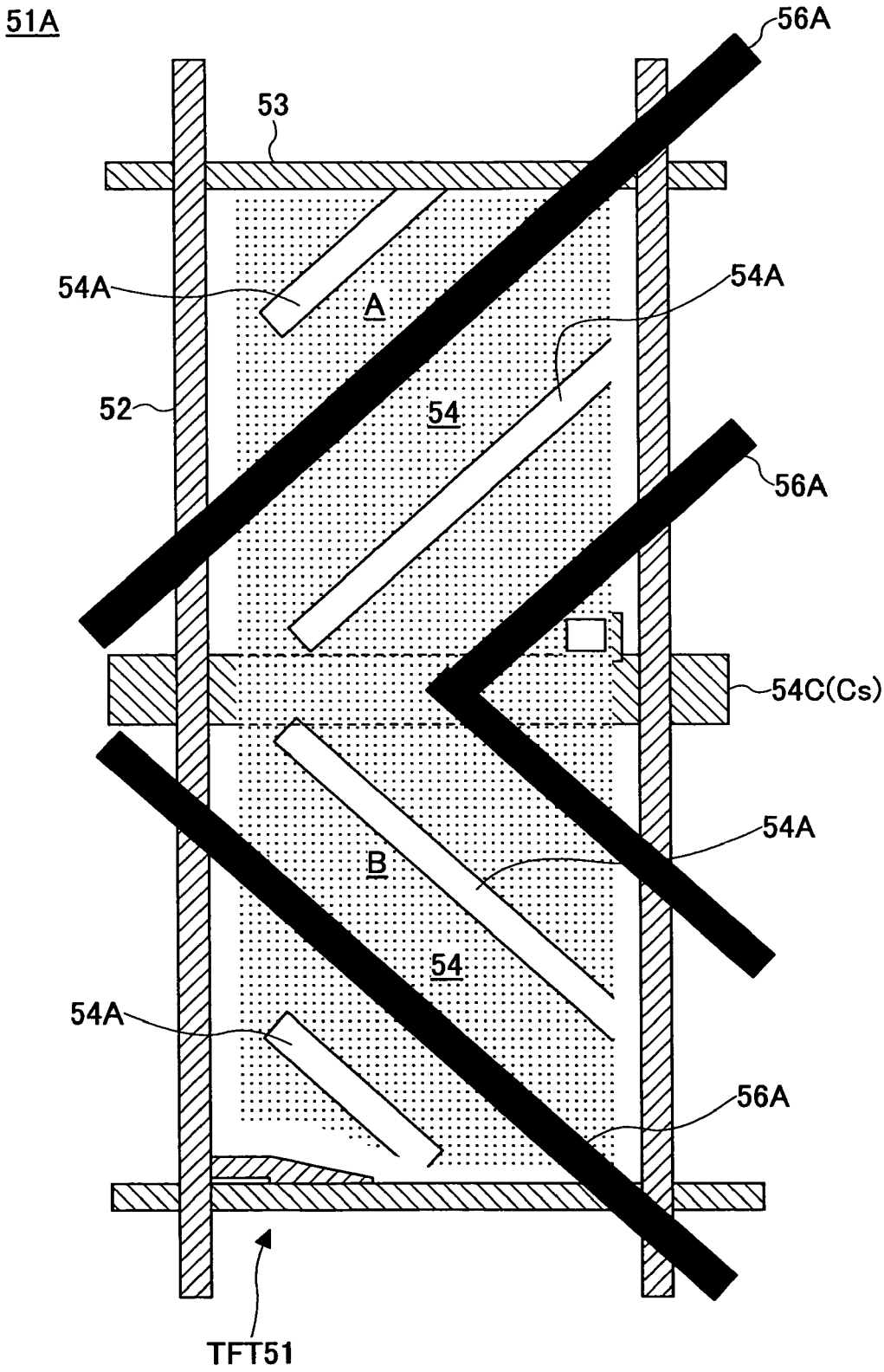
FIG. 10 is a diagram showing the pixel construction used with the liquid crystal display device of FIG. 7.

FIG. 10 shows the construction of one pixel electrode 54 formed on the substrate 51A in detail.

Referring to FIG. 10, there extend the signal electrodes 52 and the scanning electrodes on the substrate 51A in a crossing relationship, and the TFTs 51T and cooperating pixel electrodes 54 are formed in correspondence to the intersections of the electrodes 52 and 53. Further, it can be seen in FIG. 10 that there is formed an auxiliary electrode 54C (Cs) so as to extend parallel with the scanning electrode 53.

Figure 4:
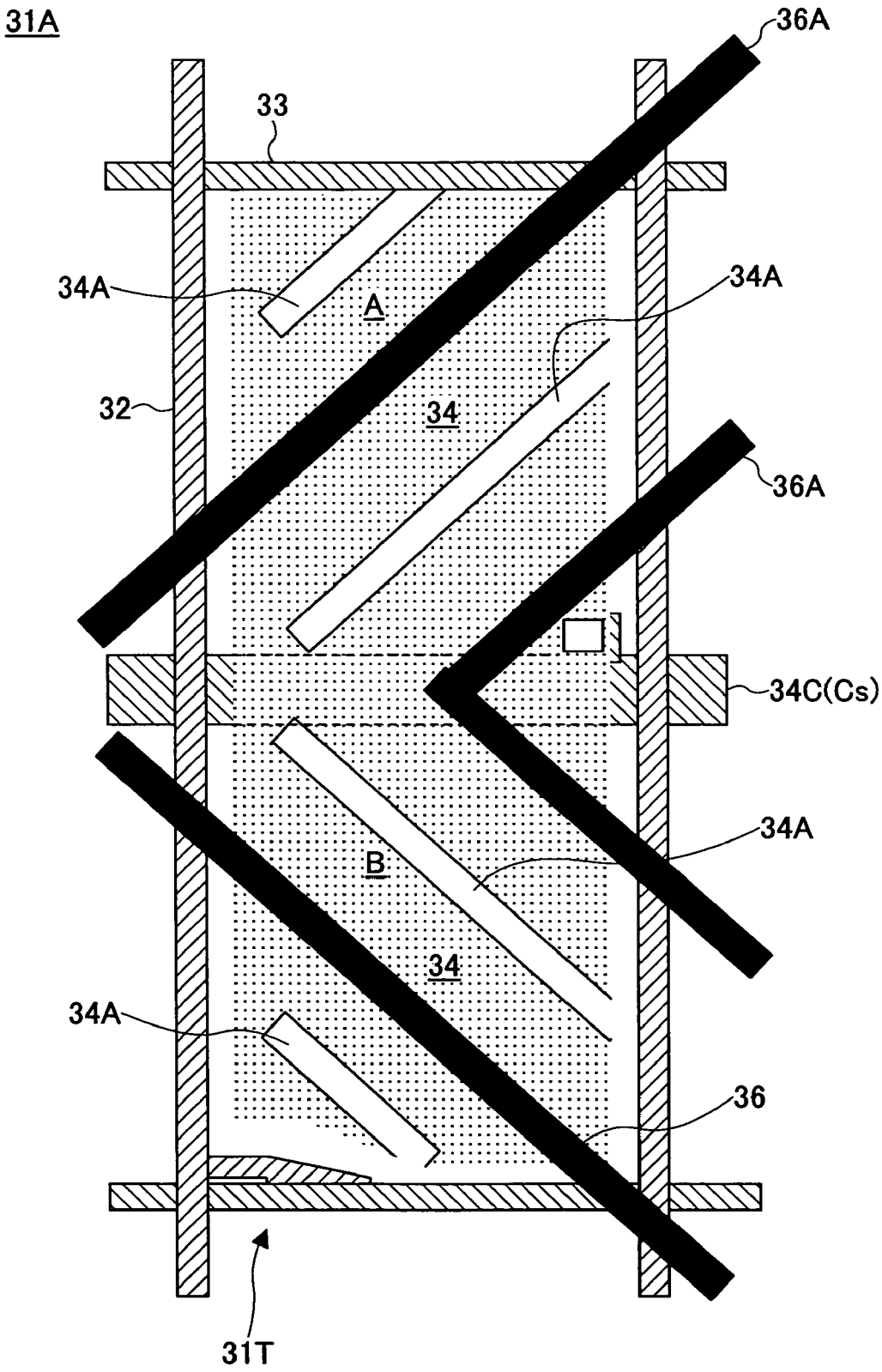
FIG. 4 is a diagram showing the pixel construction of the MVA liquid crystal display device of FIG. 2.
Figure 5:
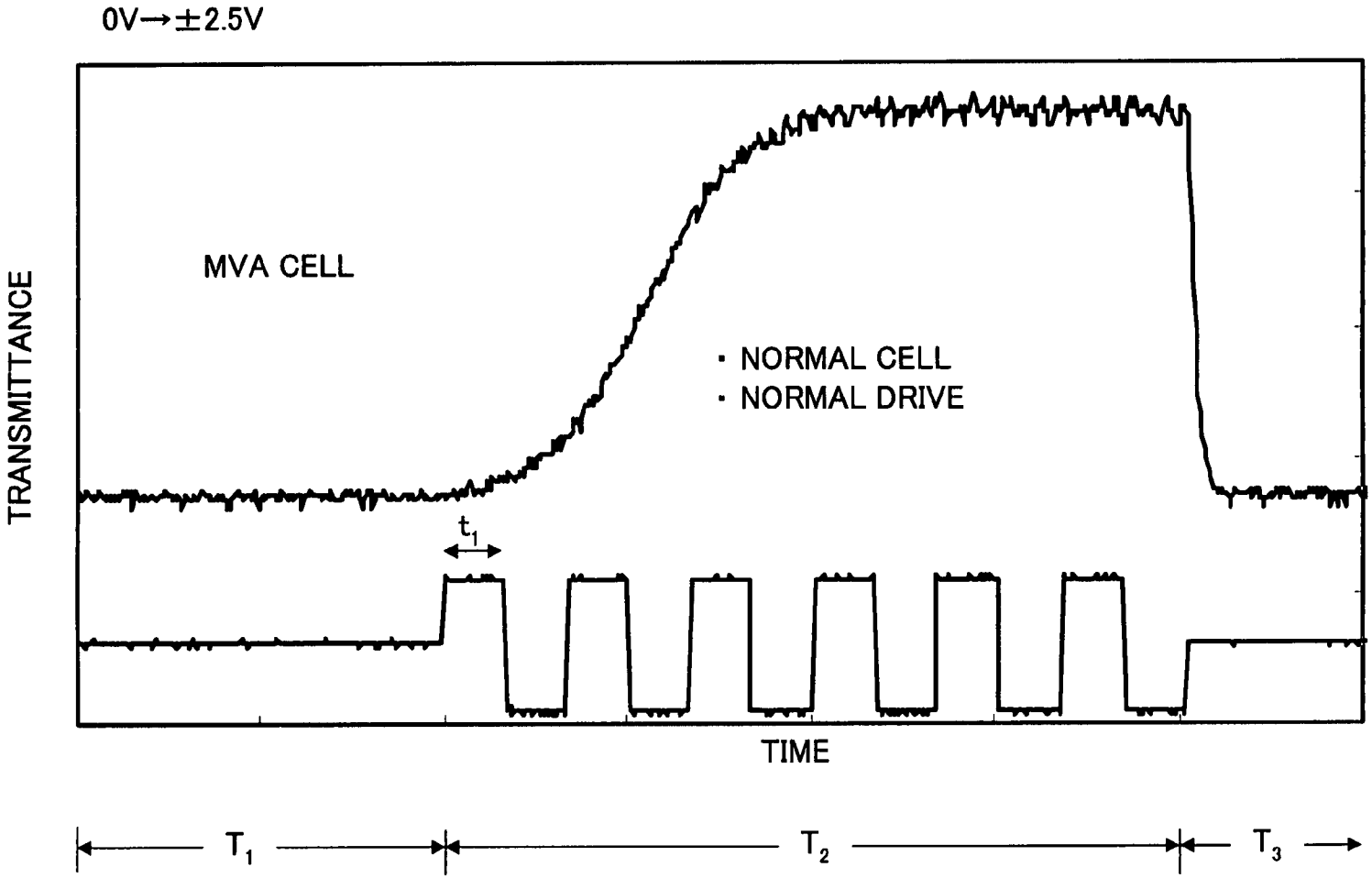
FIG. 5 is a diagram explaining the problems of the MVA liquid crystal display device of FIG. 2.

In FIG. 10, it should be noted that the pixel electrode 54, shown with mat pattern, is divided into a region A and a region B, wherein the cutout patterns 54A shown with a white strip extend on each of the regions A and B parallel with each other in correspondence to the construction of FIG. 4.

Further, it should be noted that FIG. 10 also shows the projecting patterns 56A formed on the glass substrate 51B, in addition to the pixel electrode 54 on the substrate 31A.

Next, the process of formation of the polymer layers 55*a* and 57*a* mentioned before will be explained with reference to FIGS. 11A-11C together with their functions.

Figure 11A:
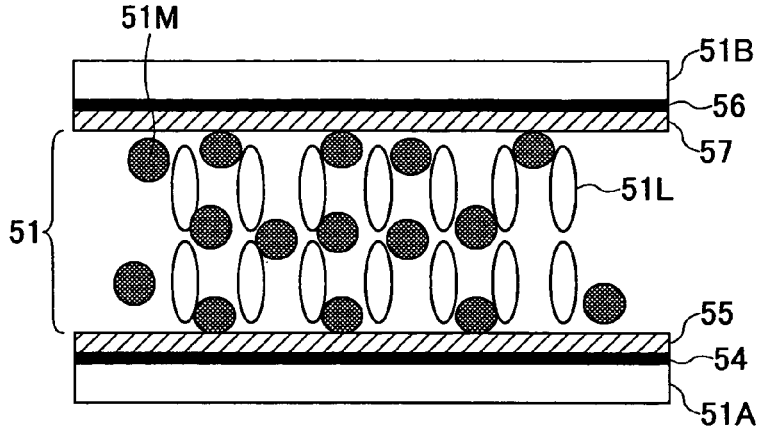
FIGS. 11A-11C are diagrams showing the fabrication process of the liquid crystal display device of FIG. 7.

Referring to FIG. 11A, there is introduced a photocuring monomer composition 51M having a liquid crystal skeleton, such as a liquid crystal mono acrylate monomer USL-001-K1 marketed from Dainippon Ink and Chemicals, Inc., is introduced with a concentration range of 0.1-3 wt %.

Figure 11B:
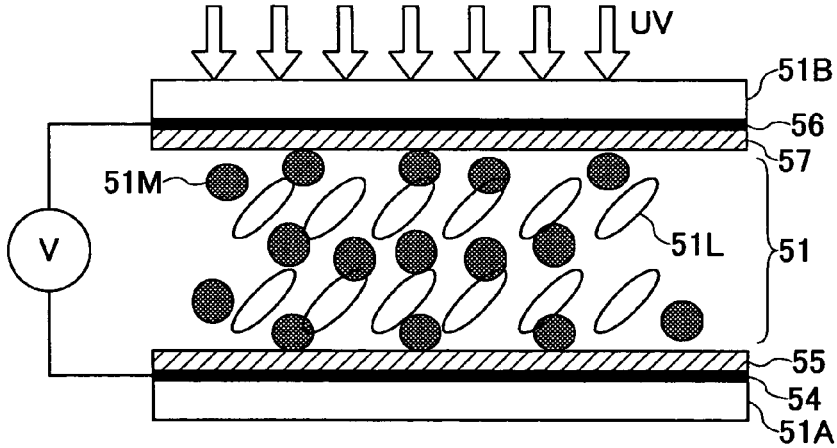
Figure 11C:
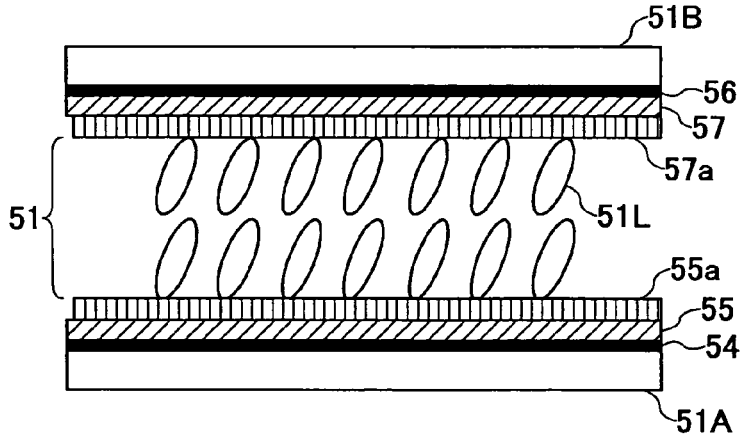

Next, in the step of FIG. 11B, a drive voltage is applied across the electrodes 54 and 56 such that tilting is caused in the liquid crystal molecules 51L. In this stage, it should be noted that the direction of tilt of the liquid crystal molecules 51L is determined by the cutout patterns 54A formed in the pixel electrode 54 or by the projecting patterns 56 formed on the opposing electrode 56. Further, in the state of FIG. 11B, ultraviolet radiation is applied to the liquid crystal layer 51 in this state and causes curing in the photocuring monomer composition 51M.

As a result, the polymer layer 55*a* is formed on the surface of the veridical alignment film 55 and the polymer layer 57*a* is formed on the surface of the vertical alignment film 57 in correspondence to the state of FIG. 9A, wherein it should be noted that the polymer layers 55*a* and 57*a* memorize the tilting direction of the liquid crystal layer 51L in the state of FIG. 11B, and thus, the liquid crystal molecules 51L are held in the slightly tilted state toward the foregoing tilting direction from the direction perpendicular to the plane of the liquid crystal layer 51.

It should be noted that the polymer layers 55*a* and 57*a* are formed respectively on the entirety of the surfaces of the alignment films 55 and 57, and thus, the tilting of the liquid crystal molecules 51L occurs promptly when tilting the liquid crystal molecules 51L by applying a drive voltage across the electrodes 54 and 56. Thereby, the response speed of the liquid crystal panel 50 is improved significantly.

Figure 12:
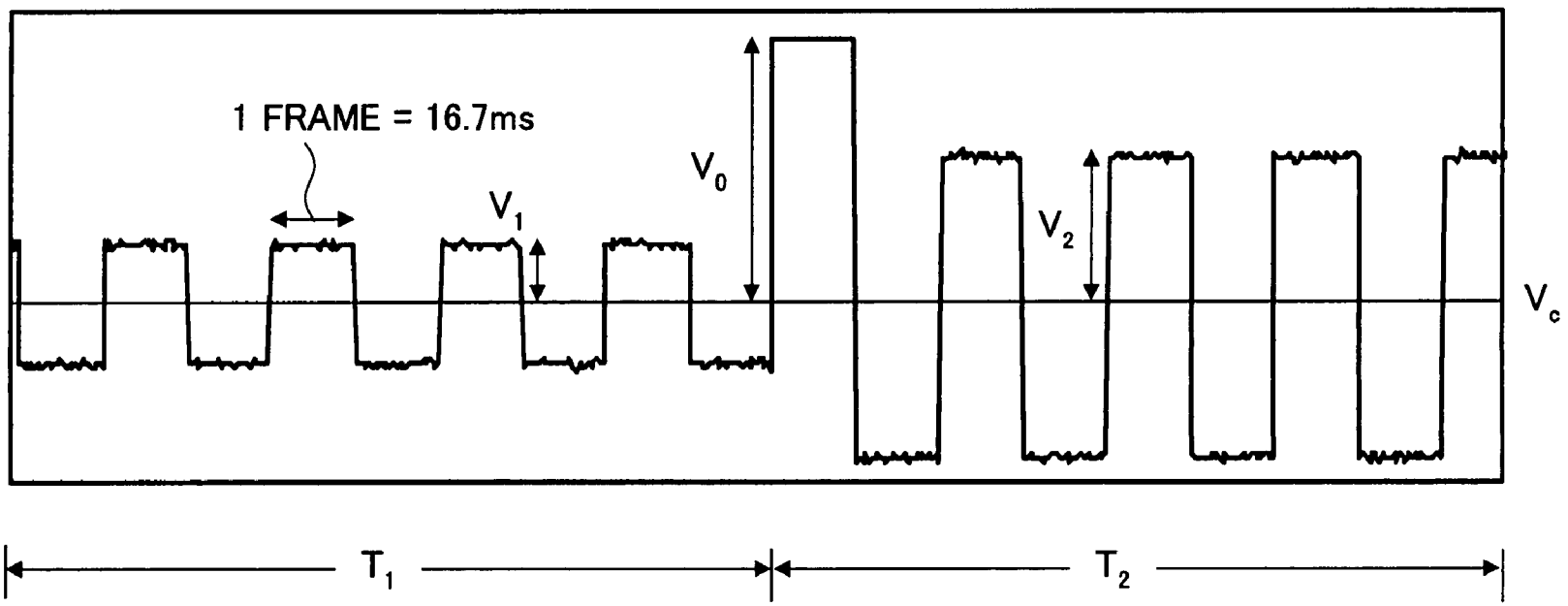
FIG. 12 is a diagram explaining the overdrive of the liquid crystal display device of FIG. 7.

In the present embodiment, in which the response speed of the liquid crystal display panel 50 is thus improved, attempt is made to improve the response speed further in the case the gradation of the represented images is changed by conducting the overdriving shown in FIG. 12.

FIG. 12 is a diagram showing the drive voltage signal waveform produced by the drive circuit 70 of FIG. 7 and applied between the electrodes 54 and 55.

Referring to FIG. 12, the drive voltage signal has a rectangular waveform changing the polarity thereof alternately about a central voltage Vc, wherein one period of each rectangular wave corresponds to one frame (16.7 mS).

In the example of FIG. 12, it should be noted that the displayed image maintains a first gradation for the first interval T1 and then causes a transition to a second gradation in the second interval T2, and in correspondence to this, the drive voltage signal is changed from the first interval T1 in which the drive voltage signal takes the value of ±V1 with regard to the central voltage Vc to the second interval T2 in which the drive voltage signal takes the value of ±V2, wherein the present embodiment increases the magnitude of the drive voltage to Vo at the moment of transition of the gradation, and hence in the first frame of the interval T2.

It should be noted that the magnitude of the overdrive voltage Vo is determined according to the equation Vo=A× V2, in which a coefficient A is multiplied to the magnitude of the drive voltage signal V2 for the second interval T2, wherein the coefficient A is determined as a function of the drive voltage V1 in the previous interval T1 and the magnitude of the voltage V2 of the current interval T2 and the temperature T.

Figure 13:
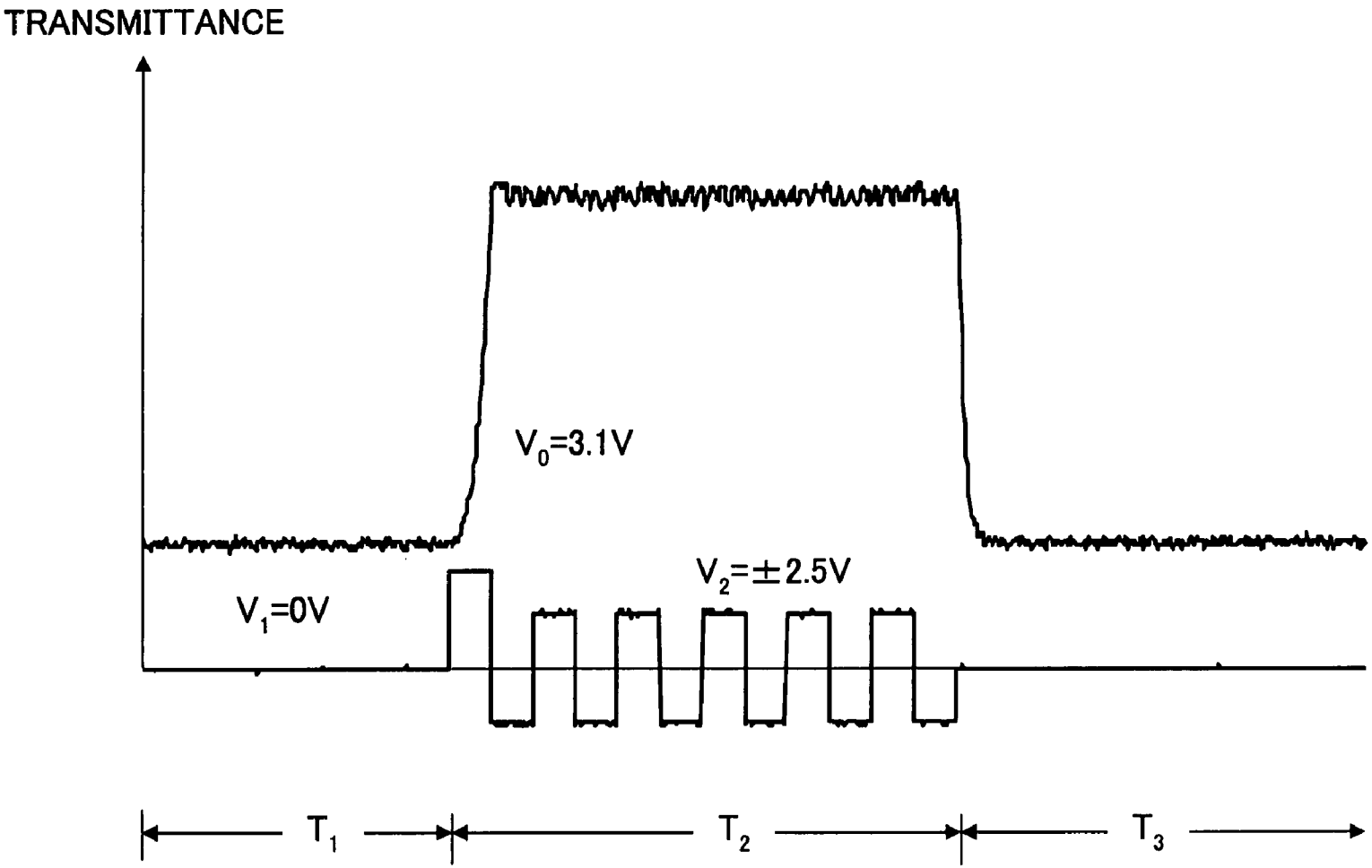
FIG. 13 is a diagram explaining the effect of the present invention.

FIG. 13 shows the transmittance of the liquid crystal panel for the case the display is changed from the dark state to the white state, and in correspondence to this, the liquid crystal display device 40 of FIG. 7 is driven by setting the drive voltage V1 for the interval T1 to 0V, the drive voltage V2 for the interval T2 to ±2.5V, and the overdrive voltage V0 to +3.1V. In the example of FIG. 13, the display is returned again to the dark state after continuing twelve frames during the interval T2.

Figure 6:
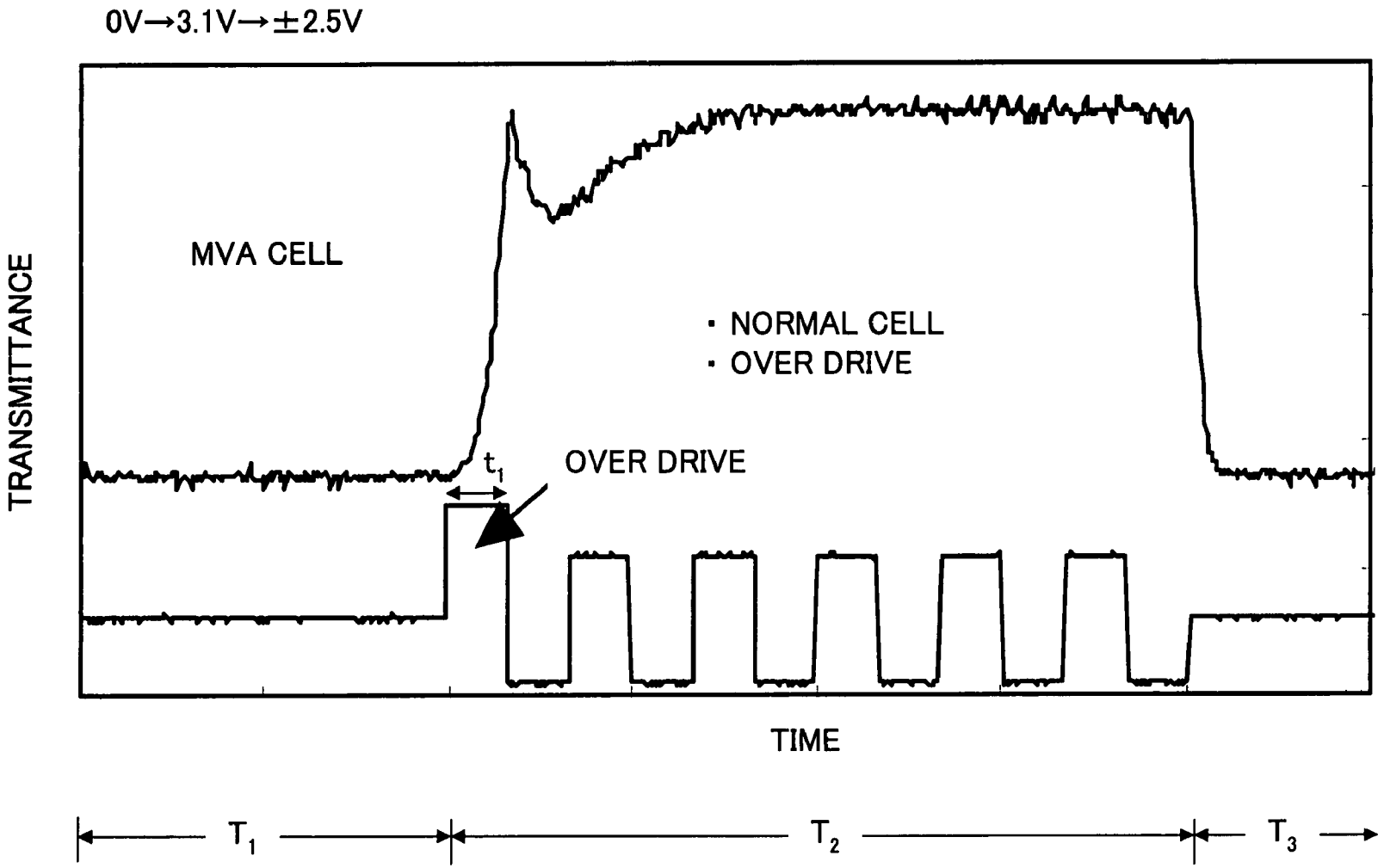
FIG. 6 is another diagram explaining the problem of the MVA liquid crystal display device of FIG. 2.

Referring to FIG. 13, the transmittance is changed already to the white state in the first frame of the interval T2 by conducting such overdriving and that there is observed no problem of swinging of the transmittance explained with FIG. 6.

Figure 14:
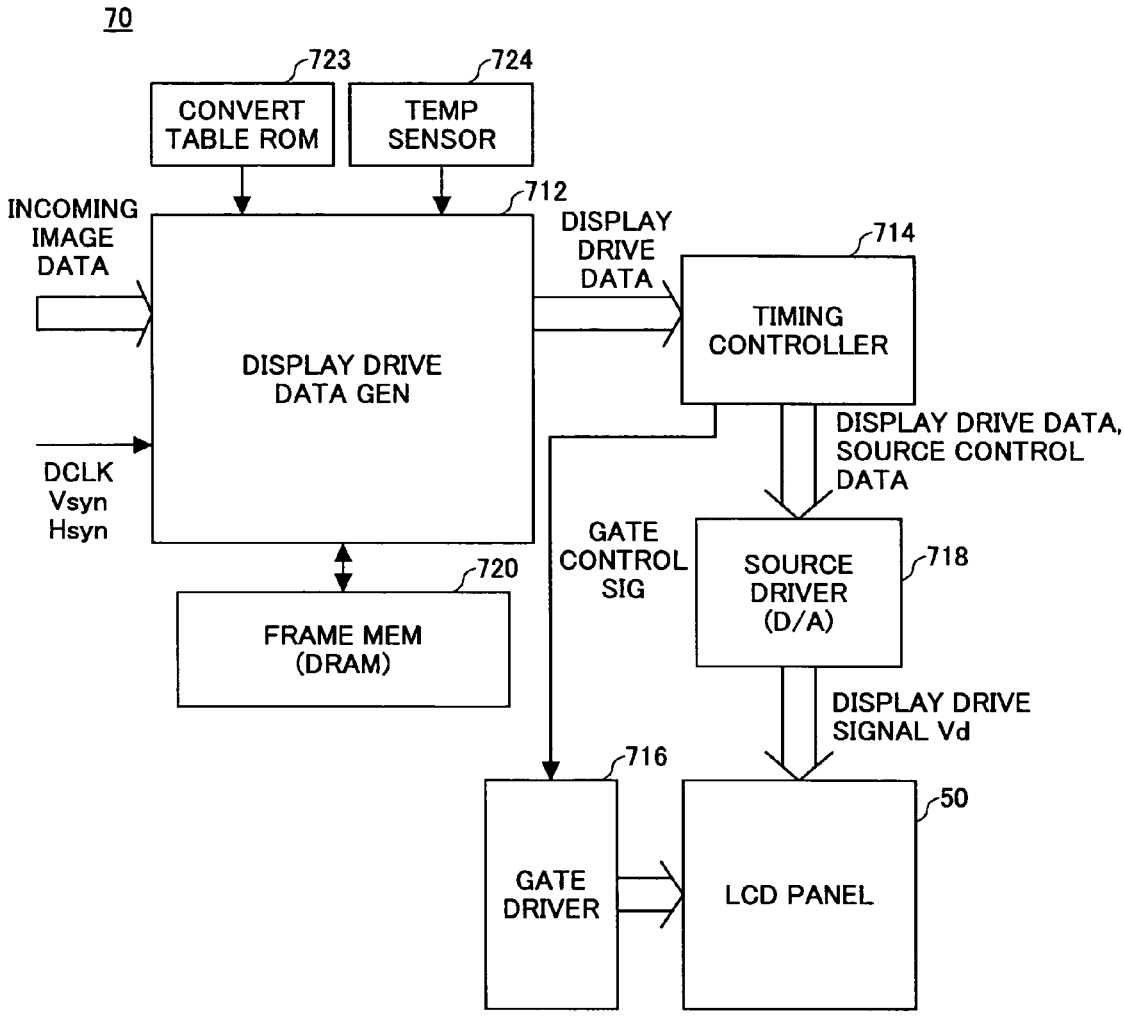
FIG. 14 is a diagram showing the construction of a drive circuit used with the liquid crystal display device of FIG. 7.

FIG. 14 shows the construction of the drive circuit 70 for conducting such overdriving.

Referring to FIG. 14, the drive circuit 70 includes: a display drive data generator 712 supplied with incident image data together with a data clock signal DCLK, a vertical synchronization signal Vsyn, a horizontal synchronizing signal Hsyn and producing display drive data therefrom; a timing controller 718 supplied with the display drive data and forming a gate control signal, display drive data and a source control signal; a gate driver 716 supplied with the gate control signal and producing an analog scanning signal, the gate driver 716 supplying the analog scanning signal to the scanning electrodes 53 of the liquid crystal display panel 50; and a source driver 718 supplied with the display drive data and the source control signal and producing an analog video signal, the source driver 718 further supplying the analog video signal thus produced to the data electrodes 52 of the liquid crystal display panel 50.

To the display drive data generator 712, it should be noted that a frame memory 720 formed of a ROM and holding the input image data of the previous frame, a conversion table holding the values of the coefficient A for various combinations of the voltage V1 and the voltage V2 and a temperature sensor 724 cooperate.

Thus, the display drive data generator 712 holds the incident image data of the previous frame in the foregoing frame memory 720 upon incoming of the image data of the current frame and seeks through the conversion table 723 for the corresponding coefficient A while using the current image data, the incident image data of the previous frame held in the frame memory 720 and the temperature data obtained by the temperature sensor 724 for the parameters. Further, the display drive data generator 712 multiplies the coefficient A thus discovered to the incident image data of the current frame and produces the display drive data.

Thus, with the present embodiment, a nearly ideal transition of transmittance such as the one shown in FIG. 13 is realized, by restricting the tilting direction of the liquid crystal molecules 51L by the polymer layers 55*a* and 57*a* and by applying the overdriving technology to such a liquid crystal display device.

Meanwhile, it should be noted that, with the liquid crystal display device of the present invention, the image of one frame is displayed over the entire screen area for the duration of full one frame interval, and hence over the full duration of 16.7 ms, in the case of displaying motion picture images with such a liquid crystal display device. Thereby, because of the visual sensory characteristics of human eyes, the changing images tend to cause the impression that different images are superimposed and blurred.

Figure 15A:
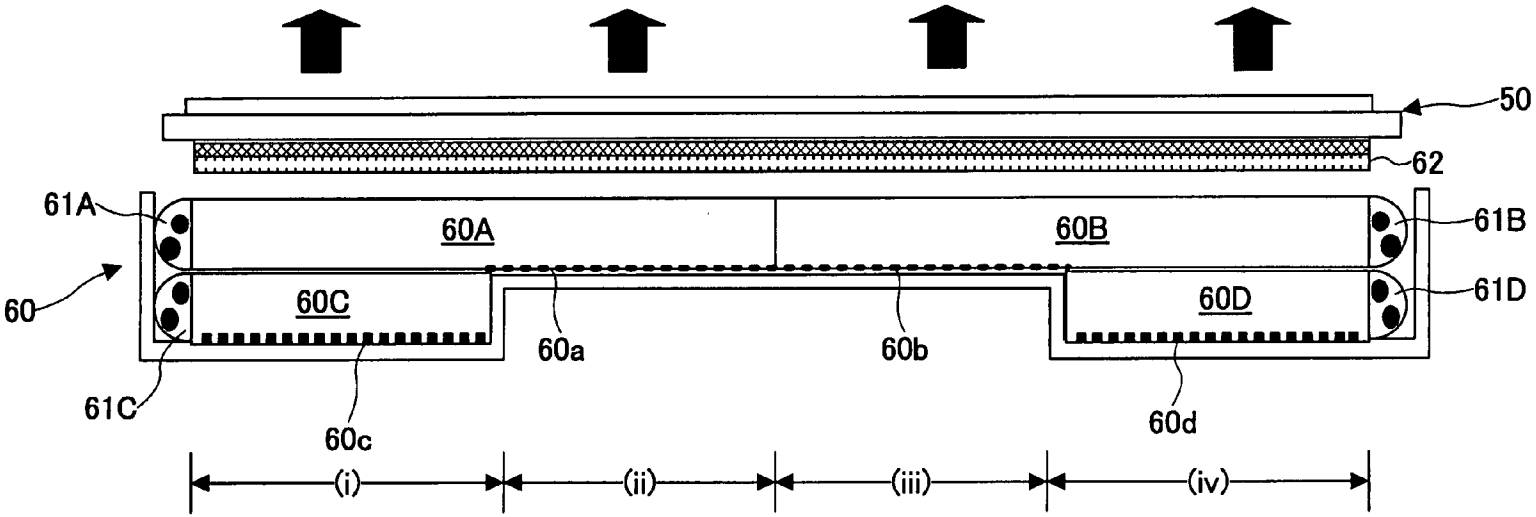
FIGS. 15A and 15B are diagrams explaining the backlight control used with the liquid crystal display device of FIG. 7.
Figure 15B:
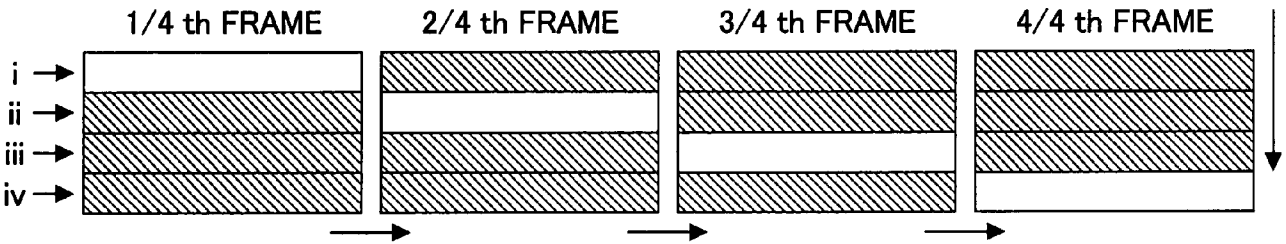

Thus, with the present embodiment, the backlight unit 60 disposed behind the liquid crystal display panel 50 shown in FIG. 7 is divided into plural subunits (i)-(iv) as shown in FIG. 15A and carry out a quasi-vertical scanning shown in FIG. 15B, by carrying out the activation of the subunits sequentially one by one.

More specifically, the backlight unit 60 includes four backlight sources 61A-61D disposed behind the liquid crystal display panel 50 at the right hand side part thereof and the left hand side part thereof, wherein the backlight sources 61A-61D includes respective light guide plates 60A-60D, and the light guide plate 60C, which is coupled with the optical source 61C, is provided with an optical scatter plate 60*c* in correspondence to the region (i).

Similarly, the light guide plate 60A coupled with the optical source 61A includes an optical scatter plate 60*a* in correspondence to the foregoing region (ii), while the light guide plate 60B coupled with the optical source 61B includes an optical scatter plate 60*b* in correspondence to the region (iii). Further, the light guide plate 60D coupled with the optical source 60D is formed with an optical scatter plate 60*d* in correspondence to the foregoing region (iv).

Thus, when the optical source 61C is activated, backlight emission is caused in the region (i) corresponding to the optical scatter plate 60*c*, while when the optical source 61A is activated, the backlight emission is caused in the region (ii) corresponding to the optical scatter plate 60*a*.

Similarly, when the optical source 61B is activated, the backlight emission is caused in the region (iii) corresponding to the optical scatter plate 60*b*, while when the optical source 61D is activated, the backlight emission is caused in the region (iv) corresponding to the optical scatter plate 60*d*.

Thus, as shown in FIG. 15B, the present embodiment achieves the activation of the optical sources 61C, 61A, 61B and 61D consecutively, and with this, the regions (i), (ii), (iii) and (iv) are scanned consecutively.

Thus, with the present embodiment, the display screen is scanned vertically within the interval of one frame by consecutively turning on and off the optical sources 61A-61C of the backlight unit 60, and the blur of the motion picture, originating from the human sensory nature, is effectively suppressed when such a backlight unit 60 is used with the construction explained before.

As noted previously, such quasi vertical scanning of the display screen by the backlight unit has caused further degradation of displayed image quality with the conventional MVA liquid crystal display device, and it has been not possible with such a conventional MVA liquid crystal display device to use the quasi vertical scanning of the display screen.

With the present invention, on the other hand, it is possible to suppress the blur of motion picture images originating from the human visual sensory nature, by combining the quasi vertical scanning achieved by on and off control of the backlight unit, and a high quality motion picture representation is achieved.

Second Embodiment

Figure 16:
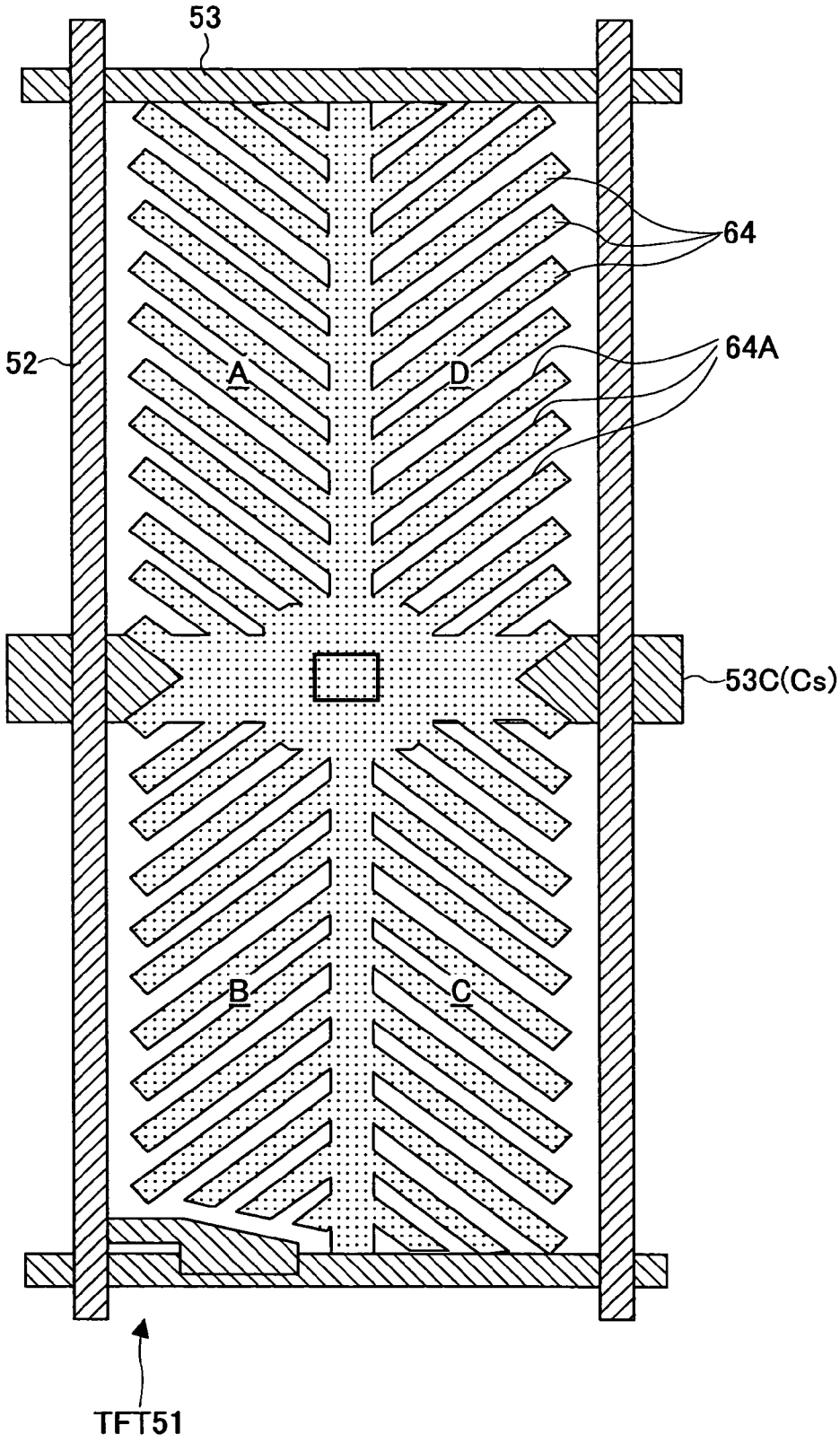
FIG. 16 is a diagram showing the pixel construction according to a second embodiment of the present invention.

FIG. 16 shows the construction of a pixel electrode according to a second embodiment of the present invention used in the construction of FIG. 9B in place of the pixel electrode 54. In FIG. 16, those parts explained previously are designated by the same reference numerals and the description thereof will be omitted.

In the embodiment of FIG. 16, it will be noted that the pixel electrode 64 is formed with a large number of minute cutout patterns 64A, and thus, the liquid crystal molecules 51L in the liquid crystal layer 51 are tilted in the elongating direction of the cutout patterns 64A in the event a drive voltage is applied to the electrode 64, due to the action of the localized electric field formed between adjacent electrode fingers across the cutout pattern 64A.

In the illustrated example, the pixel electrode 64 includes four regions A-D characterized by respective, mutually different directions for the extending direction of the cutout patterns 64A.

Further, it will be noted that the present embodiment eliminates the projecting patterns 56A formed on the substrate 51B with the previous embodiment.

Thus, the present invention is also effective with the liquid crystal display device that uses such a pixel electrode 64.

Other features of the present are similar to those of the previous embodiments, and further description thereof will be omitted.

Third Embodiment

Figure 17B:
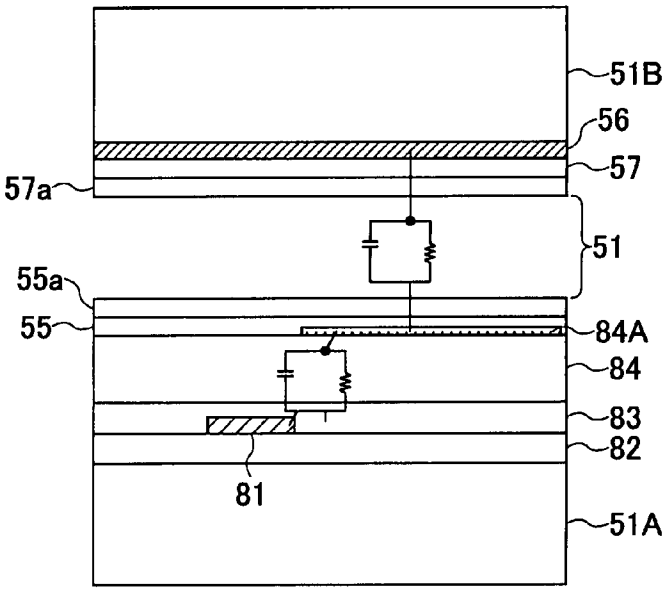
FIGS. 17A and 17B are diagrams showing the construction of the liquid crystal display device according to a third embodiment of the present invention.
Figure 17A:
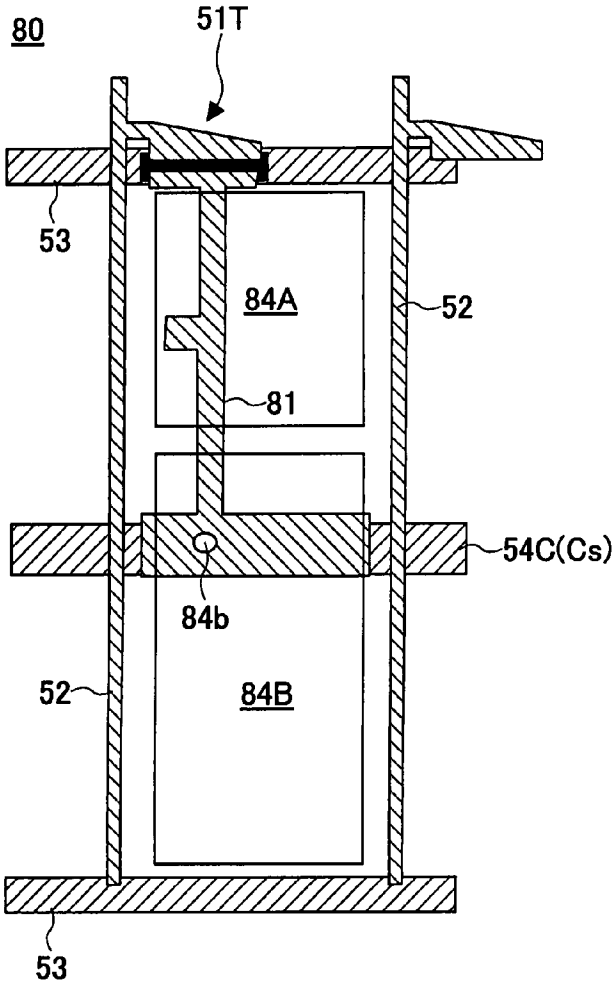

FIGS. 17A and 17B are diagrams showing the construction of a pixel used with a liquid crystal display device 80 according to a third embodiment of the present invention, wherein those parts explained previously are designated by the same reference numerals and the description thereof will be omitted.

Referring to FIG. 17A, the present embodiment uses two ITO pixel electrodes 84A and 84B in a single pixel region, wherein each of the pixel electrodes 84A and 84B is formed with the cutout patterns corresponding to the cutout patterns 54A of FIG. 10 explained previously. Further, a structure similar to the projecting pattern 56A is shown on the substrate 51B, although illustration thereof is omitted.

In the present embodiment, the pixel electrode 84B is connected to an interconnection pattern 81 extending from the TFT 51T via a via-contact 84*b* and is driven directly by the TFT 51T, while the pixel electrode 84A is driven via the capacitance formed between the interconnection pattern 81 and the electrode pattern 84A as shown in FIG. 17B. Thus, the pixel electrode 84A is a floating electrode.

Referring to FIG. 17B, the interconnection pattern 81 is formed on an interlayer insulation film covering the scanning electrode pattern 52 formed on the glass substrate 51A and is covered by an interlayer insulation film 83 carrying the source and drain electrodes of the TFT 51T. Further, the interlayer insulation film 83 is covered by another interlayer insulation film that carries thereon the pixel electrode 84.

According to the construction of the present embodiment, the pixel electrode 84A is coupled with the TFT 51T via the capacitance, and thus, the threshold characteristics for the pixel electrode 84A is different over the threshold characteristic for the case the pixel electrode 84B is driven by the TFT 51T, and the pixel electrode 84A becomes active with some delay over the pixel electrode 84B.

Thus, with the present embodiment, it becomes possible to realize excellent color representation over wide viewing angle by providing the pixel electrodes 84A and 84B with different threshold characteristics and with different area ratio.

Fourth Embodiment

Figure 18:
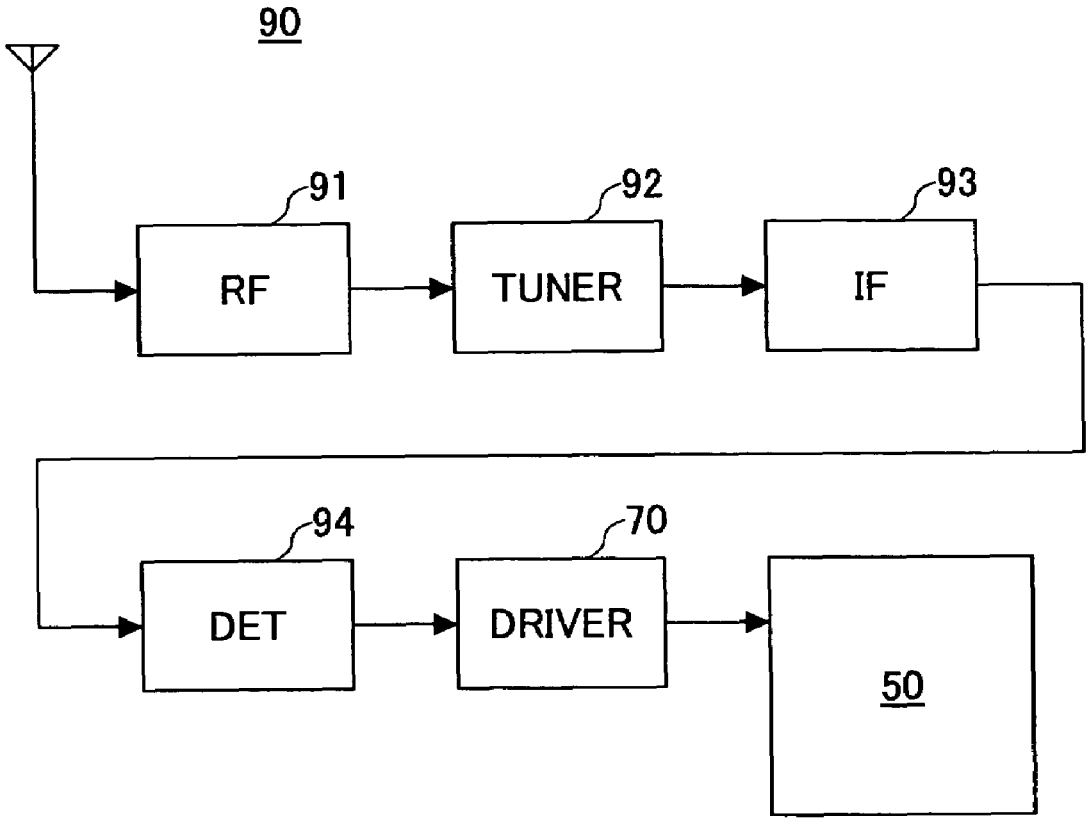
FIG. 18 is a diagram showing the construction of a television receiver set according to a fourth embodiment of the present invention.

FIG. 18 shows the construction of a television receiver set 90 according to a fourth embodiment of the present invention that uses the liquid crystal display device of the present invention.

Referring to FIG. 18, the television receiver set 90 includes: an RF amplifier connected to an antenna 90A and amplifying an RF signal such as the radio signal that contains the image signals; a tuner unit 42 converting a desired channel of the RF signal to form an IF signal by frequency conversion; an IF amplifier 93 amplifying the IF signal formed by the tuner unit 42 and eliminating other frequency signals; and a detection unit 94 detecting the IF signal amplified by the IF amplifier 93 and producing image data, wherein the detection unit 94 is connected to the driver circuit 70 that drives the liquid crystal display panel 50 with the image data.

With the television receiver set 90 of such a construction, it becomes possible to display motion picture images based on the image signal supplied to the antenna 90A with high contrast ratio and with high viewing angle, without causing the problem of swinging of the transmittance. Thereby, it should be noted that the liquid crystal display device 40 is not limited to the one explained with reference to FIG. 7 but it is also possible to use the liquid crystal display devices explained with reference to other embodiments.

According to the present embodiment, it becomes possible to achieve representation of high quality motion pictures not only with the television receiver sets of large screen but also with compact radio set such as cellular phones.

Further, the present invention is not limited to the embodiments described heretofore, but various variations and modifications may be made without departing from the scope of the invention.

What is claimed is:

1. A liquid crystal display device, comprising:

a first substrate carrying a first electrode;

a first alignment film formed on said first substrate so as to cover said first electrode;

a second substrate carrying a second electrode and opposing said first substrate;

a second alignment film formed on said second substrate so as to cover said second electrode;

a liquid crystal layer sandwiched between said first and second substrates via respective alignment films;

a first polarizer having a first optical absorption axis and disposed outside said first substrate;

a second polarizer having a second optical absorption axis perpendicular to said first optical absorption axis and disposed outside said second substrate; and a drive unit applying a drive voltage signal to said first and second electrodes, said first and second alignment films causing liquid crystal molecules of said liquid crystal layer to align in a direction generally perpendicular to a plane of said liquid crystal layer in a non-activated state of said liquid crystal display device in which no drive voltage is applied across said first and second electrodes, said first electrode constituting a pixel electrode including therein regions characterized by different tilting directions of said liquid crystal molecules, said liquid crystal molecules being inclined in each of said plural regions in a predetermined direction pertinent to said region over generally entirety of a display region of said liquid crystal display device in said non-activated state thereof, said drive unit setting the voltage of a drive voltage signal, in the case of displaying a first gradation image having a first gradation and subsequently and continuously displaying a second gradation image having a second gradation, such that a magnitude of said drive voltage signal is increased larger than a predetermined voltage of said drive signal for said second gradation during a first frame interval of displaying said second gradation images wherein said drive unit determines a magnitude of said drive voltage signal of a current frame based on image data of a previous frame and image data of said current frame and wherein said drive unit determines the magnitude of said drive voltage signal of said current frame, when a gradation of a displayed image is changed from a first state to a second state, while using image data of the last frame in which said displayed image takes said first state and the image data of the first frame in which said displayed image takes said second state respectively for said image data of said previous frame and said image data of said current frame.

2. The liquid crystal display device as claimed in claim 1, wherein each of said first and second alignment films are formed with respective first and second polymer layers that cause tilting in said liquid crystal molecules in said predetermined direction, said first and second alignment layers making a contact with said liquid crystal layer via said first and second polymer layers, respectively.

3. The liquid crystal display device as claimed in claim 2, wherein there are formed first and second structures restricting an alignment direction of said liquid crystal molecules in said liquid crystal layer respectively on said first and second electrodes, said direction of restricting alignment direction by said first and second structures is set coincident to said predetermined tilting direction caused in said liquid crystal molecules by said first and second polymer layers.

4. The liquid crystal display device as claimed in claim 2, wherein there are repeatedly formed plural cutout patterns each extending parallel with each other in said predetermined tilting direction on said first electrode.

5. The liquid crystal display device as claimed in claim 2, wherein said first and second polymer layers comprises a polymer layer formed by curing a photocuring monomer composition having a liquid crystal skeleton.

6. The liquid crystal display device as claimed in claim 3, wherein said first structure comprises a cutout pattern formed on said first electrode so as to extend in a direction perpendicular to said predetermined tilting direction, said second structure comprises a projecting pattern formed on said second electrode so as to extend in parallel with said cutout pattern.

7. The liquid crystal display device as claimed in claim 3, wherein said first structure is covered with said first alignment film and said first polymer layer, and wherein said second structure is covered with said second alignment film and said second polymer layer.

8. The liquid crystal display device as claimed in claim 1, wherein said pixel electrode comprises a first pixel electrode connected to an active device on said substrate and a second, floating pixel electrode coupled with said active device via a capacitance.

9. The liquid crystal display device as claimed in claim 1, wherein said drive unit determines the magnitude of said drive voltage signal based on said image data of said previous frame and said image data of said current frame based on a conversion table.

10. The liquid crystal display device as claimed in claim 1, wherein said first electrode is disposed in plural numbers on said first substrate in rows and columns as a pixel electrode, a backlight unit being disposed behind said liquid crystal display device, said backlight unit illuminating one of plural regions each including plural pixel electrodes sequentially during an interval of one frame.

11. A television receiver set comprising:

a signal processing circuit supplied with a high frequency signal including a video signal and a synchronization signal, said signal processing circuit extracting said video signal and said synchronization signal therefrom;

a drive circuit producing a drive voltage signal from said video signal; and a liquid crystal display device driven by said drive voltage signal, said liquid crystal display device comprising:

a first substrate carrying a first electrode;

a first alignment film formed on said first substrate so as to cover said first electrode;

a second substrate carrying a second electrode and opposing said first substrate;

a second alignment film formed on said second substrate so as to cover said second electrode;

a liquid crystal layer sandwiched between said first and second substrates via respective alignment films;

a first polarizer having a first optical absorption axis and disposed outside said first substrate;

a second polarizer having a second optical absorption axis perpendicular to said first optical absorption axis and disposed outside said second substrate; and a drive unit applying a drive voltage signal to said first and second electrodes, said first and second alignment films causing liquid crystal molecules of said liquid crystal layer to align in a direction generally perpendicular to a plane of said liquid crystal layer in a non-activated state of said liquid crystal display device in which no drive voltage is applied across said first and second electrodes, said first electrode constituting a pixel electrode including therein regions characterized by different tilting directions of said liquid crystal molecules, said liquid crystal molecules being inclined in each of said plural regions in a predetermined direction pertinent to said region over generally entirety of a display region of said liquid crystal display device in said non-activated state thereof, said drive unit setting the voltage of a drive voltage signal, in the case of displaying a first gradation image having a first gradation and subsequently and continuously displaying a second gradation image having a second gradation, such that a magnitude of said drive voltage signal is increased larger than a predetermined voltage of said drive signal for said second gradation during a first frame interval of displaying said second gradation image.

wherein said drive unit determines a magnitude of said drive voltage signal of a current frame based on image data of a previous frame and image data of said current frame and wherein said drive unit determines the magnitude of said drive voltage signal of said current frame, when a gradation of a displayed image is changed from a first state to a second state, while using image data of the last frame in which said displayed image takes said first state and the image data of the first frame in which said displayed image takes said second state respectively for said image data of said previous frame and said image data of said current frame.

12. The television set as claimed in claim 11, wherein each of said first and second alignment films are formed with respective first and second polymer layers that cause tilting in said liquid crystal molecules in said predetermined direction, said first and second alignment layers making a contact with said liquid crystal layer via said first and second polymer layers, respectively.

13. The television set as claimed in claim 12, wherein there are formed first and second structures restricting an alignment direction of said liquid crystal molecules in said liquid crystal layer respectively on said first and second electrodes, said direction of restricting alignment direction by said first and second structures is set coincident to said predetermined tilting direction caused in said liquid crystal molecules by said first and second polymer layers.

14. The television set as claimed in claim 12, wherein there are repeatedly formed plural cutout patterns each extending parallel with each other in said predetermined, tilting direction on said first electrode.

15. The television set as claimed in claim 12, wherein said first and second polymer layers comprises a polymer layer formed by curing a photocuring monomer composition having a liquid crystal skeleton.

16. The television set as claimed in claim 13, wherein said first structure comprises a cutout pattern formed on said first electrode so as to extend in a direction perpendicular to said predetermined tilting direction, said second structure comprises a projecting pattern formed on said second electrode so as to extend in parallel with said cutout pattern.

17. The television set as claimed in claim 13, wherein said first structure is covered with said first alignment film and said first polymer layer, and wherein said second structure is covered with said second alignment film and said second polymer layer.

18. The television set as claimed in claim 11, wherein said pixel electrode comprises a first pixel electrode connected to an active device on said substrate and a second, floating pixel electrode coupled with said active device via a capacitance.

19. The television set as claimed in claim 11, wherein said drive unit determines the magnitude of said drive voltage signal based on said image data of said previous frame and said image data of said current frame based on a conversion table.

20. The television set as claimed in claim 11, wherein said first electrode is disposed in plural numbers on said first substrate in rows and columns as a pixel electrode, a backlight unit being disposed behind said liquid crystal display device, said backlight unit illuminating one of plural regions each including plural pixel electrodes sequentially during an interval of one frame.

* * * * *